US007501027B2

(12) United States Patent
Ahmed et al.

(10) Patent No.: US 7,501,027 B2
(45) Date of Patent: Mar. 10, 2009

(54) NON-CHLORINATED CONCENTRATED ALL-IN-ONE ACID DETERGENT AND METHOD FOR USING THE SAME

(75) Inventors: Fahim U. Ahmed, Greensboro, NC (US); N. Camelia Traistaru, Gladstone, MO (US)

(73) Assignee: DeLaval Holding AB, Kansas City, MO (US)

( * ) Notice: Subject to any disclaimer, the term of this patent is extended or adjusted under 35 U.S.C. 154(b) by 0 days.

(21) Appl. No.: 11/860,277

(22) Filed: Sep. 24, 2007

(65) Prior Publication Data

US 2008/0015134 A1 Jan. 17, 2008

Related U.S. Application Data

(62) Division of application No. 10/916,147, filed on Aug. 11, 2004.

(51) Int. Cl.

| | |
|---|---|
| ***C11D 1/00*** | (2006.01) |
| ***C11D 3/26*** | (2006.01) |
| ***C11D 3/30*** | (2006.01) |
| ***C11D 3/386*** | (2006.01) |
| ***B08B 3/04*** | (2006.01) |

(52) U.S. Cl. ..... 134/42; 510/384; 510/386; 510/387; 510/321; 510/421; 510/477; 510/488; 510/499

(58) Field of Classification Search ..... 510/384, 510/386, 387, 321, 421, 477, 488, 499; 134/42
See application file for complete search history.

(56) References Cited

U.S. PATENT DOCUMENTS

| | | | | |
|---|---|---|---|---|
| 4,404,040 | A | 9/1983 | Wang | |
| 4,853,146 | A | 8/1989 | Rorig et al. | |
| 5,330,769 | A | 7/1994 | McKinzie et al. | |
| 5,391,379 | A | 2/1995 | McKinzie et al. | |
| 5,698,507 | A | 12/1997 | Gorlin et al. | |
| 5,783,537 | A | 7/1998 | Ahmed et al. | |
| 5,975,095 | A | 11/1999 | Ahmed et al. | |
| 6,172,028 | B1 * | 1/2001 | Baur et al. | 510/361 |
| 6,420,329 | B1 | 7/2002 | Callaghan et al. | |
| 6,423,675 | B1 | 7/2002 | Coughlin et al. | |
| 6,472,199 | B1 | 10/2002 | Monken | |
| 6,472,358 | B1 | 10/2002 | Richter et al. | |
| 6,534,075 | B1 | 3/2003 | Hei et al. | |
| 6,537,957 | B1 | 3/2003 | Cardola et al. | |
| 6,630,434 | B2 | 10/2003 | Besse et al. | |
| 2002/0193278 | A1 | 12/2002 | Cermenati et al. | |
| 2003/0099745 | A1 | 5/2003 | Grinstead et al. | |

FOREIGN PATENT DOCUMENTS

| | | |
|---|---|---|
| DE | 3833047 | 4/1990 |
| DE | 19640201 | 4/1998 |
| EP | 0588912 | 3/1994 |
| EP | 0626129 | 11/1994 |
| EP | 0751211 | 1/1997 |
| EP | 0929641 | 7/1999 |
| EP | 1052894 | 11/2000 |
| WO | WO 9323517 | 11/1993 |
| WO | WO 9502044 | 1/1995 |
| WO | WO 9623579 | 8/1996 |
| WO | WO 9725403 | 7/1997 |
| WO | WO 9814547 | 4/1998 |
| WO | WO 9705227 | 11/1998 |
| WO | WO 9939568 | 8/1999 |
| WO | WO 9947631 | 9/1999 |
| WO | WO 9950380 | 10/1999 |
| WO | WO 0056853 | 9/2000 |

* cited by examiner

*Primary Examiner*—Gregory R Del Cotto
(74) *Attorney, Agent, or Firm*—Hovey Williams LLP

(57) ABSTRACT

Non-chlorinated concentrated acid detergent compositions and methods for using the same are provided. More particularly, the acid detergents comprise a quantity of a fatty alkyl-1,3-diaminopropane or salt thereof and optionally alkylsulfonic acid. The detergents form the basis for an all-in-one cleaning, sanitizing, and descaling composition for use on soiled surfaces, particularly surfaces contaminated with milk soils and other food soils.

20 Claims, 4 Drawing Sheets

NON-CHLORINATED CONCENTRATED ALL-IN-ONE ACID DETERGENT AND METHOD FOR USING THE SAME

RELATED APPLICATION

This application is a divisional of U.S. patent application Ser. No. 10/916,147, filed Aug. 11, 2004, which is incorporated by reference herein.

BACKGROUND OF THE INVENTION

1. Field of the Invention

The present invention is generally directed toward concentrated acid detergent compositions and methods of using the composition, either as a concentrate or as a diluted use solution, to clean, sanitize, and remove scale from a soiled surface. More particularly, the acidic detergent compositions according to the present invention comprise a fatty alkyl-1,3-diaminopropane or salt thereof and optionally a lower alkyl sulfonic acid.

2. Description of the Prior Art

Adequate cleaning of food preparation surfaces is a necessity to ensure the safety of the food supplied to consumers. This is especially true for the dairy industry, food preparation and processing plants, including food and beverage plants, and particularly in the area of milk handling. Fresh milk must be immediately cooled and refrigerated after being obtained from the cow in order to prevent the milk from spoiling. Consequently, the piping systems which handle the flow of milk must be cleaned at least twice after each milking in order to remove milk soils so as to prevent contamination of the fresh milk supply during subsequent milking operations.

Turning now to FIG. 1, milk fat is made up of a wide distribution of alkyl triglycerides. Chain lengths labeled with a ":1", ":2", or ":3" represent a carbon chain containing one, two, or three unsaturated carbon-carbon bonds, respectively. The lower carbon chains (i.e., C8 and below) are generally water soluble. However, the higher carbon chains (i.e., C10 and above) are only slightly soluble or insoluble in water. Therefore, in order to clean a surface soiled with milk fat, ordinary warm water may be used to remove the lower carbon chain fats, while some kind of detergent is needed to assist with removal of the high carbon chain fats.

In addition to milk fat, milk also contains various soluble minerals (such as calcium) and proteins (such as casein and whey). Milk proteins at elevated temperatures tend to denature and tenaciously adhere to surfaces in layers. These layers of denatured milk protein are difficult to remove. The soluble minerals can combine with milk proteins to form scaling, also known as milk stone. Milk stone is generally insoluble in ordinary tap water and alkaline systems, but is soluble under acidic conditions. Conventionally, acid solutions of mineral acids and organic acids have been used to remove these scales.

Even if the milk fat, milk protein, and milk stone are removed from a surface, residual microorganisms may still be present on the surface. Therefore, some sanitization of the surface needs to be performed in order to reduce the level of microorganism populations to safe levels established by public health ordinances or levels proven acceptable by practice. A sanitized surface is, by Environment Protection Agency (EPA) regulation, a consequence of both an initial cleaning treatment followed with a sanitizing treatment resulting in a reduction in population of at least 99.999% reduction (a 5-log reduction) for a given microorganism. In order for a product to be certified under European Standard Method EN 1040 as a disinfectant or antiseptic, the product must demonstrate at least a 99.999% reduction ($10^5$ reduction) of *Pseudomonas aeruginosa* (ATCC 15442, CIP 103467) and *Staphylococcus auerus* (ATCC 6538, CIP 483) at 20° C. for 5 minutes contact time at the product's recommended use concentration. Similarly, for a product to be certified under European Standard Method EN 1276, as a sanitizer for food contact surfaces, the product must demonstrate at least a 99.999% reduction ($10^5$ reduction) in viable counts of *Pseudomonas aeruginosa* (ATCC 15442, CIP 103467), *Escherichia coli* (ATCC 6538, CIP 54127), *Staphylococcus auerus* (ATCC 6538, CIP 483), and *Enterococcus hirae* (ATCC 10541, CIP 5855) at 20° C. for 5 minutes contact time at its recommended use concentration under simulated clean conditions (0.3 g/L bovine albumin) or dirty conditions (3 g/L bovine albumin).

The presence of residual food soil can inhibit sanitizing treatments by acting as a physical barrier that shields microorganisms lying within the soil layer from the biocide or by inactivating sanitizing treatments by direct chemical interaction. A complete cleaning process must address all three cleansing elements (cleaning, sanitizing, and descaling) in order to provide a hygienic environment for all food processing surfaces, especially milk processing surfaces.

The technology of cleaning in the food process industry has traditionally been empirical. For example, most dairies employ the clean-in-place (CD) method, involving the flushing of contaminated equipment surfaces with cleaning solution(s). For example, the equipment is rinsed with lukewarm (110-120° F.) water, followed by a hot wash using a chlorinated alkaline detergent at 160-175° F., and lastly a cold acidic rinse using a mineral acid based composition such as phosphoric acid, sulfuric acid, and nitric acid based compositions.

Hypochlorite or chlorine bleaches are effective in degrading protein by oxidative cleavage and hydrolysis of the peptide bond. However, the use of chlorinated detergent solutions in the food processing industry is not problem-free. Corrosion is a constant concern, as is the degradation of polymeric gaskets, hoses, and appliances. Available chlorine concentrations must initially be at least 75 ppm, and preferably at least 100 ppm for an optimum removal of protein film (see, WO9947631). At concentrations of less than 50 ppm of available chlorine, protein soil build-up is worsened by formation of insoluble, adhesive chloro-proteins (see, Journal of Dairy Science, 53(2), 248-251, 1970). In Scandinavian countries, dairy farmers are able to obtain premium pricing for milk obtained with equipment that is not cleaned with chlorinated cleaning products.

Furthermore, chlorine concentrations are not easy to maintain or analytically discern in detersive solutions. The effectiveness of chlorine on protein soil removal diminishes as solution temperature and pH decreases. Also, chlorine can react with organic materials to form carcinogenic chlorocarbons, such as chloromethane, di- and trichloromethane, and chloroethane.

There exists a real and substantial need in the art for a non-chlorine, acidic detergent composition capable of cleaning, sanitizing, and descaling food preparation surfaces, particularly milking systems. In addition, there is a need for a detergent composition capable of performing all three cleansing processes (cleaning, sanitizing, and descaling) in a single step washing cycle.

SUMMARY OF THE INVENTION

The present invention overcomes the above problems and provides an "all-in-one" concentrated liquid detergent composition capable of cleaning, sanitizing, and descaling in a single step with one detergent. Compositions according to the present invention comprise a fatty alkyl-1,3-diaminopropane or salt thereof having the general formula R—NH—$CH_2CH_2CH_2NH_2$, wherein R is a substituted or unsubstituted, straight or branch, saturated or unsaturated C4-C22 alkyl group in an acid matrix. It is preferable that the R group correspond as closely as possible to the fatty alkyl group distribution of the soil being cleaned. Preferably, the fatty alkyl-1,3-diaminopropane is derived from natural sources, such as coconut, soy, tallow, or oleo sources. Preferred alkyl diaminopropane salts include acetate salts formed in situ by the addition of acetic acid to the alkyl diaminopropane.

The inventive detergent provides cleaning, sanitizing, and descaling functionality in a single composition. Preferred embodiments of the detergent composition also include a mixture of inorganic and organic acids which provide descaling and sanitizing action. Exemplary inorganic and organic acids are described in greater detail below. In addition, it is preferable to include sanitizing agents to enhance the sanitizing effect of the detergent composition. It is also preferable to include one or more additional ingredients such as surfactants, one or more sequesterants, builders, and chelating agents. It is also particularly preferable to include a quantity of a lower-alkyl sulfonic acid (such as methanesulfonic acid) to further enhance the cleaning performance of the detergent.

The detergent concentrate is capable of being diluted with water to form a use solution. Preferably, the concentrate is diluted at a weight ratio of between about 1:10 to 1:300, and more preferably between about 1:100 to 1:250. An exemplary use solution expressed in terms of volume of concentrate per total volume of solution is about 0.3-1.0 oz/gal. The pH of the concentrated detergent composition is less than about 4, preferably between about 0.1-4, more preferably between about 0.75-3.5, and most preferably between about 1.0-2.5. Preferably, the pH of the diluted use solution is from about 0.1-6.0, and more preferably from about 2.0-5.5.

The diaminopropane detergent may also include an acid active or acid resistant enzymes to give added cleaning functionality. Preferred enzymes for use with the present invention exhibit a high level of activity over the pH ranges noted above. Exemplary acid active or acid resistant enzymes are those selected from the group consisting of acid active or acid resistant protease enzymes, acid lipolase enzymes, lipase enzymes, acid resistant amylase enzymes, cellulase enzymes, acid peroxidase, and combinations thereof.

Because the present detergents are capable of being used with CIP systems, detergent foaming is undesirable and should be minimized as much as possible. In applications where foaming is not a concern high foaming surfactants may be used. However, preferred detergent formulations comprise a low foaming surfactant or surfactant system that tends to dissipate foam rapidly. As explained in greater detail below, a synergistic effect has been discovered from the use of at least two different surfactants. Foaming in certain detergents employing a dual surfactant system can be significantly less than foaming in detergents employing only one of the two individual surfactants. Therefore, the present invention provides a method of reducing the foaming of an acidic detergent through the addition of a fatty alkyl-1,3-diaminopropane or salt thereof to the detergent composition.

The detergents according to the present invention are useful in cleaning food processing plants, beverage plants, and food preparation surfaces, especially surfaces contaminated with milk soils. Methods of cleaning according to the invention generally comprise providing a detergent concentrate as described above and applying it to a surface. Preferably, the detergent concentrate is diluted prior to application to the surface to form a use solution. The detergents are particularly suited for use with recirculating cleaning systems (i.e., CIP systems) in food processing and beverage plants, especially milk-handling systems.

DETAILED DESCRIPTION OF THE PREFERRED EMBODIMENT

Figure 1:
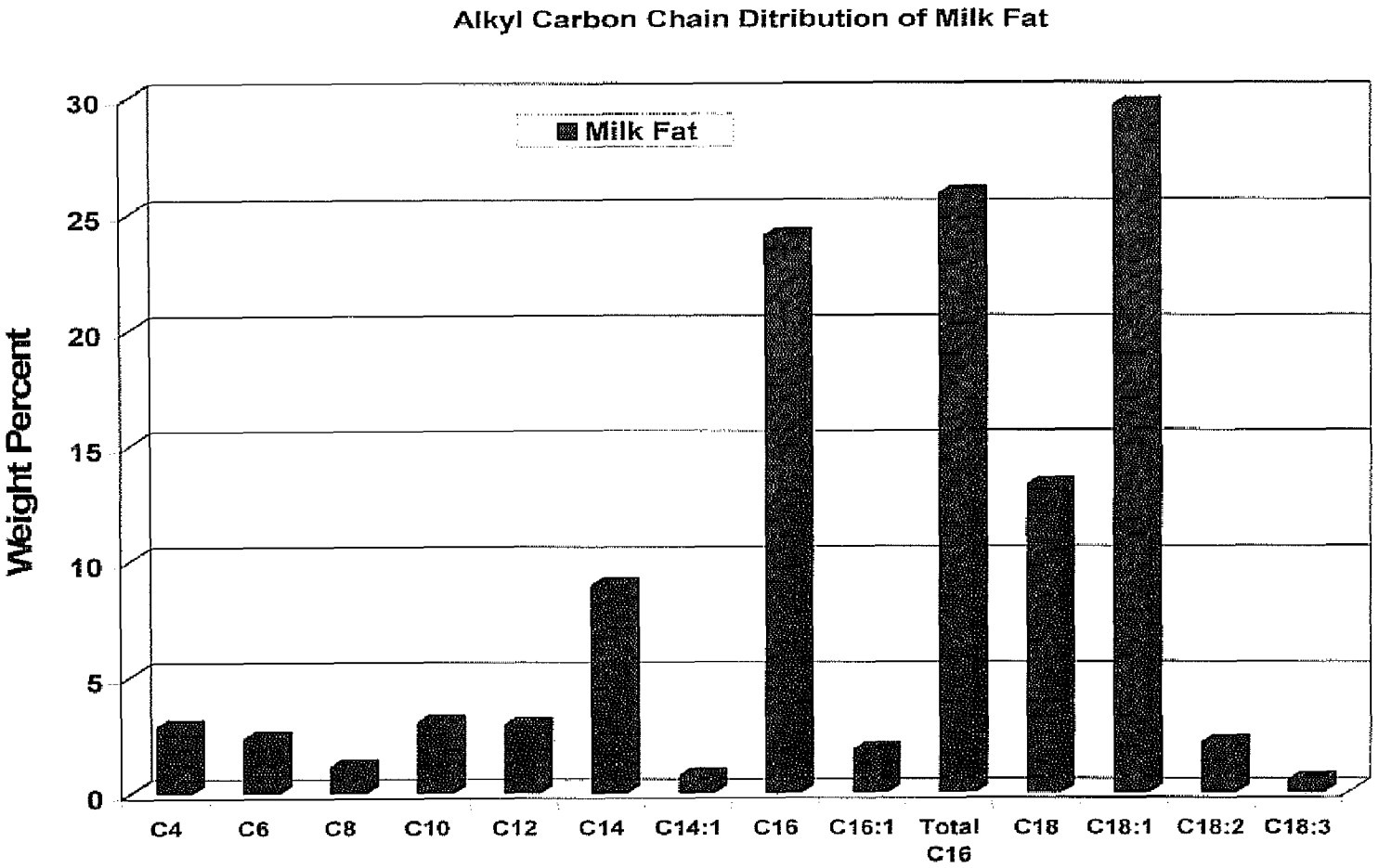
FIG. 1 is a graph showing the alkyl carbon chain distribution of milk fat.

The following examples set forth preferred detergent compositions and methods of making and using the same in accordance with the invention. It is to be understood, however, that these examples are provided by way of illustration and nothing therein should be taken as a limitation upon the overall scope of the invention.

Cleaning Procedures

Many of the following examples involve cleaning evaluations of acid detergents according to the present invention. The cleaning efficacies of the samples were compared to those of commercially available chloro alkaline detergents. In these cleaning tests, 304 stainless steel, plastic, or glass panels measuring 3"×6"×0.0037", having a ¼" hole at one end were at first washed with a powder chloro-alkaline detergent, rinsed with water and wiped with xylene, then with isopropanol, followed by drying in an oven (100-110° C., for 10-15 minutes) to insure complete evaporation of the solvents. The panels were suspended in the oven by attaching a rigid wire hanger to the panel hole, so that no contact was made with the oven or other items within the oven. The dried panels were then removed from the oven, and allowed to cool for at least 20 minutes. The panels were then carefully handled so as to eliminate contact with soil sources, and the initial weight of each panel was recorded to the nearest 0.1 mg.

Evaporated milk was then emptied into to a 1 L beaker along with an equivalent volume of de-ionized water, and the mixture was stirred to insure homogeneity. Up to three panels were placed in the milk by setting the end without the hole on the bottom of the beaker and propping the other end of the panel against the side of the beaker. Approximately ⅞ of the panel was immersed in the milk. The panels were allowed to sit in the milk for 15 minutes and then drained in the air for 5 minutes. Each panel side was then rinsed with 50 ml of 400 ppm of synthetic hard water previously heated to 90-100° F. Care was taken to pour the rinse water over each side of the panel so as to contact all of the soiled areas of the panel. The rinse water was allowed to drain off each panel and then the panels were hung in a 40° C. oven to dry. The panels were then removed from the oven and allowed to cool for at least 15 minutes. After cooling, the panels were weighed and each weight was recorded to the nearest 0.1 mg. The soil deposition, rinsing, drying and weighing cycle was carried out a total of five times for each panel, or until the soil weight fell within the range of 10-15 mg.

The soiled panels were then washed in a 1 L beaker using the inventive detergents and the control products. Approximately 800 ml of synthetic hard water (23.5 grains/gal, 400 ppm of water hardness made by AOAC method) was placed in the beaker along with a specified amount of the detergent. All experimental detergents and all liquid controls were used at 0.5 wt % (i.e., 5 g/L concentration), whereas the powder chloroalkaline detergent was used at 0.2 wt % (2 g/L concentration). The cleaning solution was heated using a hot plate to a temperature of 60° C., unless otherwise specified. In some wash cycles, a stress wash condition was used by lowering the wash temperature to below 60° C. and/or reducing the washing time to less than 8 minutes.

Each test panel was first immersed in the detergent solution for a period of 8 minutes with agitation via a magnetic stir bar. After the wash, each panel was removed from the wash bath and immediately rinsed in tap water for about 5 seconds. The panel was then suspended within the 40° C. oven for a period of about 15 minutes to dry. The panel was removed from the oven, cooled in the air for about 30 minutes and then reweighed. The weight of the panel after the wash cycle was then compared with the soiled weight thereof before the wash cycle to determine the percent soil removed. Each wash trial was performed in triplicate and the results averaged to give a percent soil removed.

Acid Detergent Formulations

The liquid compositions of the present invention are acidic and comprise an organic or inorganic acid or both. The acids can be any organic or inorganic acids known to those skilled in the art, however, it is preferred to use a mixture of a weak and a strong organic acid (i.e., citric acid and methane sulfonic acid) and a weak and a strong inorganic acid (i.e., nitric, sulfuric, and phosphoric acid) or any such combination. The combination of citric and phosphoric acid and methane sulfuric acid, surprisingly, results in an increase in cleaning efficacy.

Preferred organic acids include weak C1 to C4 carboxylic acids. Exemplary weak carboxylic acids include acetic acid, hydroxyacetic acid, propionic acid, hydroxypropionic acid, a-ketopropionic acid, citric acid, butylic acid, mandelic acid, valeric acid, succinic acid, tartaric acid, malic acid, oxalic acid, fumaric acid, adipic acid or mixtures thereof.

Additional preferred organic acids for use in detergent formulations according to the present invention include citric acid, maleic acid, sorbic acid, benzoic acid, succinic acid, glutaric acid, adipic acid, α-hydroxy acids such as glycolic acid and lactic acid, ethylenediaminetetraacetic acid (EDTA), phosphonic acid, octyl phosphonic acid, acrylic acid, polyacrylic acid, aspartic acid, polyaspartic acid, p-hydroxybenzoic acids, and combinations thereof. Citric acid is particularly preferred.

Other preferred organic acids suitable for use with inventive detergents are iminoacetic acids having the general formula

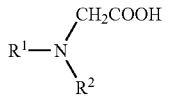

wherein $R^1$ is selected from the group consisting of —$(CH_2)_n$COOH, H, alkyl, alkylaryl, aryl, —$(CH_2)_n$COOH, —CH[$(CH_2)_n$COOH]$_2$ and —CH(COOH)—$(CH_2)_n$COOH, where n is from 1-8; and $R^2$ is selected from the group consisting of —$(CH_2)_n$COOH, —CH[$(CH_2)_n$COOH]$_2$, —CH(COOH)—$(CH_2)_n$COOH and —$(CH_2)_n$COOH, —CH[$(CH_2)_n$COOH]$_2$ and —CH(COOH)—$CH_2$ COOH, where n is from 1-8. Mixtures of such acids may be also used.

Yet additional preferred organic acids are those having the general formula $R^1$—$SO_3H$ wherein $R^1$ is a Ci-C16 alkyl group.

Preferred inorganic acids include mineral acids such as sulfuric acid, nitric acid, phosphoric acid, sulfamic acid, hydrochloric acid, and mixtures thereof. Sulfamic acids and phosphoric acids are also helpful in descaling soiled surfaces.

Preferably, the inventive detergent compositions comprise hydrotrope compatible acids in sufficient concentration to provide use solutions having a pH from about 0.1-6, more preferably from about 0.15-5, and most preferably from about 0.2-3. The term "hydrotrope compatible acid" means that the acid employed is compatible with the hydrotrope used in the composition without causing significant degradation or instability to the hydrotrope or acid. Exemplary hydrotrope compatible acids include citric acid, phosphoric acid, methanesulfonic acid and sulfamic acid. Phosphoric acid is particularly advantageous acid because it also provides some hydrotropic properties to solubilize nonionic surfactants that may be incorporated with the detergents. Phosphoric acid and sulfamic acid are also particularly advantageous for use in cleaning dairy pipelines as they tend to dissolve milk stone.

Preferred compositions according to the present invention comprise from about 1-80% by weight acid (either organic, inorganic, or a mixture of both), more preferably from about 5-70% by weight, even more preferably from about 10-60% by weight, and most preferably from about 15-50% by weight. Unless otherwise noted, all weight percentages expressed herein are based on the weight of the entire composition.

In the trials shown in Table 1, several acidic detergent formulations (having pH values of less than 3) were first tested for cleaning effectiveness because acidic conditions are a requirement for descaling. These compositions produced moderate cleaning of the milk soil, however, the control, a chloroalkaline detergent, out-performed the acidic formulations each time.

TABLE 1

Acidic Detergent Formulations

| | Formulation | | | | | | | | | |
|---|---|---|---|---|---|---|---|---|---|---|
| Ingredients | 1 | 2 | 3 | 4 | 5 | 6 | 7 | 8 | 9 | 10 |
| Deionized Water | 59 | 62 | 63 | 59 | 39 | 40 | 42 | 41 | 40 | 36 |
| Anhydrous Citric Acid | 10 | 10 | 10 | 10 | 20 | 20 | 20 | 20 | 20 | 20 |
| Phosphoric Acid (75%) | 10 | 10 | 10 | 10 | 20 | 20 | 20 | 20 | 20 | 20 |

TABLE 1-continued

| Acidic Detergent Formulations | | | | | | | | | | |
|---|---|---|---|---|---|---|---|---|---|---|
| | Formulation | | | | | | | | | |
| Ingredients | 1 | 2 | 3 | 4 | 5 | 6 | 7 | 8 | 9 | 10 |
| Sulfamic Acid | 0 | 0 | 0 | 0 | 0 | 0 | 5 | 5 | 5 | 0 |
| Sulfuric Acid | 0 | 0 | 0 | 0 | 0 | 0 | 0 | 0 | 0 | 5 |
| Triton DF-12 (NI Surfactant) | 1 | 1 | 0 | 1 | 1 | 0 | 1 | 2 | 3 | 3 |
| Capric/Caprylic Acid (40/60) | 2 | 2 | 2 | 0 | 2 | 2 | 2 | 2 | 2 | 2 |
| Propylene Glycol | 2 | 2 | 2 | 2 | 2 | 2 | 2 | 2 | 2 | 2 |
| Sodium Octyl Sulphonate | 10 | 10 | 10 | 10 | 10 | 10 | 10 | 10 | 10 | 14 |
| | Single Phase Clear Liquid | — | — | Single Phase Clear Liquid | Clear Liquid | — | Clear Liquid | Clear Liquid | Clear Liquid | Clear Liquid |
| pH: 5 g/L (400 ppm, ° C.) | 2.78(52)/ 2.80(54)/ 2.77(53) | 2.82(55) | 2.77(53) | 2.77(53) | 2.37(52)/ 2.46(61, 65) | 2.37(53) | 2.33(59)/ 2.34(66) | 2.33(56) | 2.34(55) | 2.25(58) |
| Cleaning Performance | | | | | | | | | | |
| Usage Concentration, g/L | 5 g/L | 5 g/L | 5 g/L | 5 g/L | 5 g/L | 5 g/L | 5 g/L | 5 g/L | 5 g/L | 5 g/L |
| Wash Temperature, ° C. | 56/57/58 | 57 | 55 | 56 | 56/60/71 | 55 | 60/71 | 61 | 59 | 59 |
| Milk Soil Cleaning/ 400 ppm, % | 79/83/73 | 94 | 97 | 86 | 89/84/88 | 96 | 85/86 | 87 | 90 | 77 |
| Powder Chloroalkaline Detergent Control @ 2 g/L, % | 96/99/100 | 100 | 100 | 100 | 100/94 | 100 | 94 | 94 | 94 | 94 |
| Average Milk Soil Load, mg | 7/19 | 24 | 24 | 19 | 13/39/29 | 24 | 40 | 28 | 30 | 31 |
| Soil Load on the Control, mg | 11/20 | 26 | 24 | 20 | 20/26 | 24 | 26 | 26 | 26 | 26 |

Acid Active and Acid Resistant Enzymes

In view of the acid detergent results, similar formulations were then tested using acid active or acid resistant enzymes to determine whether cleaning performance of the acid compositions could be improved upon. Enzymes present numerous advantages for use in cleaning detergents, especially in that they provide cleaning functionality at lower temperatures, are non-corrosive to stainless steel equipment, are relatively stable in hard water conditions, and are biodegradable. Enzymes are highly chemo-selective and work very efficiently if the working pH and temperature of the system can be matched to those of the enzyme to exploit their maximum activity. Therefore, with regard to the present invention, it is important to identify acid active or acid resistant protease enzymes that are effective against milk soils and are also stable in organic acids and inorganic acids that are used for sanitization and descaling.

An exemplary acid protease suitable for use with the detergents of the present invention is acid fungal protease AFP 2000 from Genencor which is derived from a selected strain of *Aspergillus niger*. The activity of AFP 2000 protease is about 2000 SAPU/g (Spectrometric Acid Protease Unit per grain). One SAPU will liberate one μmole of tyrosine per minute under assay conditions. This acid enzyme has a molecular weight of about 43 kDa and also includes side activities of amylase, hemicellulase, and pectinase. The pH activity range for AFP 2000 protease is from about 2.5 to 6.0, with optimum performance at about pH 3.0. AFP 2000 protease is effective over a temperature range of about 45-55° C. (113-131° F.), with optimum performance at about 48° C. (118° F.).

Another exemplary acid protease is Genencor's GC 106 which is an acid proteolytic enzyme characterized by its ability to hydrolyze proteins under low pH conditions. GC 106 is obtained from controlled fermentation of a selected strain of *Aspergillus niger*. The activity of GC 106 protease is about 1000 SAPU/g. The pH activity range for GC 106 protease is from about 2.5 to 6.0, with optimum performance at about pH 2.5 to 3.5. GC 106 protease is most effective in temperatures of up to about 55° C. (131° F.), with optimum performance at 45-50° C. (113-122° F.).

Validase AFP from Valley Research, South Bend, Ind., is a food-grade, acid stable protease enzyme derived from the controlled fermentation of *Aspergillus niger*. This product is characterized by its ability to hydrolyze proteins in acidic environments. Validase AFP 2000 (powder form) has an activity of 2000 SAPU/g and Validase AFP 1000 (liquid form) has an activity of 1000 SAPU/g. The pH activity range for Validase AFP is from about pH 2.5 to 6.0, with about pH 2.5 to 3.5 being optimum. Validase AFP is effective in temperatures up to about 55° C., and optimally, from about 45-50° C.

Yet another preferred acid resistant protease enzyme is a fungal protease manufactured by Solvay Enzymes through controlled fermentation of *Aspergillus oryzae* var having an activity of about 20,000 to about 750,000 HUT/g. The HUT activity is determined according to the AF92/2 method published by Novo Nordisk A/S, Denmark. A HUT is the amount of the enzyme which forms a hydrolysate at 40° C. and a pH of 4.7 over 30 minutes from the digestion of denatured hemoglobin equivalent in absorbency at 275 nm to a solution of 1.10 μg/ml tyrosine in 0.006 N HCl (absorbency=0.0084). The denatured hemoglobin substrate is digested by the enzyme in a 0.5 M acetate buffer at the given conditions. Undigested hemoglobin is precipitated with trichloroacetic acid and the absorbance of the hydrolysate in the supernatant is measured at 275 nm.

The preferred protease enzyme dosage for the present inventive compositions is from about 200-4,000 HUT/L, more preferably from about 500-3,000 HUT/L, and most preferably 650-2,000 HUT/L.

An acid lipolase or lipase may also be used in combination with an acid protease. Validase Fungal Lipase 8000 from Valley Research is a purified food grade lipase powder derived from a selected stain of *Rhizopus oryzae* (ATCC 1996) and is characterized by its ability to hydrolyze triglycerides. Validase Fungal Lipase 8000 has an activity of 8000 LU/g, is effective up to a temperature of about 50° C., with about 40° C. being optimal. Validase Fungal Lipase 8000 is a very stable over a wide pH range, from about 2.0-10.0, with a pH of about 6.5 being optimal.

Another preferred lipase for use with the present invention is a yeast lipase from Bio-Cat, Troy, Va. derived from the yeast *Candida rugosa*. This enzyme is a food-grade, non-specific lipase typically utilized for lipid modification. The yeast lipase is standardized to have an activity of about 200,000 FIP/g and has broad activity at pH between about 4 to 8 and temperatures between about 20 to 60° C. One unit of enzyme activity is defined as that quantity of a standard Lipase preparation (Fungi Lipase-International FIP standard) that liberates the equivalent of 1 μmole of fatty acid from olive oil per minute under the prescribed assay conditions. The specific activity is expressed in International FIP units per mg of enzyme preparation.

Acid resistant amylase enzymes may also be used in the present inventive formulations. These enzymes include α-amylases of *Bacillus amyloliquefaciens* having an activity of about 300,000 to 1,500,000 MWU/g, and particularly Tenase-1200, Tenase L-1200 and Tenase L-340 from Solvay Enzymes, Inc.

Other acid resistant enzymes suitable for acid detergent compositions according to the present invention are Fungamyl amylase, Novocor AD lipase, and cellulase enzymes such as Celluzyme, Carezyme, Cellucast; Guardzyme peroxidase, all available from Novo Nordisk A/S, Denmark.

The detergent compositions can comprise up to about 20% by weight enzyme, preferably from about 0.5-10% by weight, and more preferably from about 1-8% by weight. Preferred enzymes are selected from the group consisting of acid protease, acid lipase, acid amylase, acid peroxidase and combinations thereof.

Tables 2-2c give exemplary enzymatic acid detergents in accordance with the present invention. The cleaning power of a number of the compositions was greatly improved when compared with the simple acidic detergents of Table 1.

TABLE 2

| Enzymatic Acid Detergents | | | | | |
|---|---|---|---|---|---|
| | Formulation | | | | |
| Ingredients | 11 | 12 | 13 | 14 | 15 |
| Deionized Water | 62 | 86 | 62 | 83.33 | 82.33 |
| Anhydrous Citric Acid | 15 | — | 30 | 10 | 10 |
| Phosphoric Acid (75%) | 6 | — | — | 4 | 4 |
| Sulfamic Acid | — | 8 | — | 2.67 | 2.67 |
| Triton DF-12 (NI Surfactant) | 1 | — | — | — | 1 |
| Capric/Caprylic Acid (40/60) | — | — | 2 | — | — |
| Sodium Octyl Sulphonate | 10 | — | — | — | — |
| Vallidase AFP 1000 SAPU(L) | 6 | 6 | 6 | 6 | 6 |
| pH: 5 g/L (400 ppm, ° C.) | 2.92(57) | 2.94(57) | 2.82(57) | 2.86(55) | 2.89(57) |
| Cleaning Performance | | | | | |
| Usage Concentration, g/L | 5 g/L | 5 g/L | 5 g/L | 5 g/L | 5 g/L |
| Wash Temperature, ° C. | 55 | 57 | 57 | 55 | 57 |
| Milk Soil Cleaning/400 ppm, % | 84 | 86 | 84 | 86 | 93 |
| Powder Chloroalkaline Detergent Control @ 2 g/L, % | 92 | 92 | 92 | 92 | 92 |
| Average Milk Soil Load, mg | 23 | 24 | 20 | 19 | 19 |
| Soil Load on the Control, mg | 26 | 23 | 23 | 23 | 23 |

TABLE 2a

| Enzymatic Acid Detergents | | | |
|---|---|---|---|
| | Formulation | | |
| Ingredients | 16 | 17 | 18 |
| Deionized Water | 23 | 33 | 62 |
| Anhydrous Citric Acid | 20 | 20 | 10 |
| Phosphoric Acid (75%) | 20 | 20 | 10 |
| Sulfamic Acid | 0 | 0 | 0 |
| Sulfuric Acid | 0 | 0 | 0 |
| Triton DF-12 (NI Surfactant) | 2 | 2 | 1 |
| Capric/Caprylic Acid (40/60) | 10 | 5 | 2 |
| Propylene Glycol | 2 | 2 | 2 |
| Sodium Octyl Sulphonate | 18 | 13 | 10 |
| Vallidase AFP 2000 SAPU(P) | 5 | 5 | 3 |
| Vallidase AFP 1000 SAPU(L) | — | — | — |
| pH: Neat (° C.) | 1.17(21) | 1.12(20) | 1.28(20) |
| pH: 2 g/L (Deionized Water, ° C.) | — | 2.57(22) | — |
| pH: 5 g/L (Deionized Water, ° C.) | — | — | 2.47(21) |
| pH: 2 g/L (400 ppm, ° C.) | 2.95(23) | 2.80(22) | — |
| pH: 5 g/L (400 ppm, ° C.) | — | — | 2.70(22) |
| pH: 1 g/L (400 ppm, ° C.) | 3.96(53) | — | — |
| pH: 2 g/L (400 ppm, ° C.) | 3.04(53)/ 2.99(49) | 3.00(52)/ 2.98(56) | — |
| pH: 5 g/L (400 ppm, ° C.) | — | — | 2.84(55)/ 2.75(53) |
| Cleaning Performance | — | — | 2.78(52) |
| Usage Concentration, g/L | 1 g/L 2 g/L | 2 g/L | 5 g/L |
| Wash Temperature, ° C. | 55 | 55/56 | 57/55 C/57 |
| Milk Soil Cleaning/400 ppm, % | 44, 75, 80 | 95, 32 | 94, 47, 77 |
| Dinamate Control @ 2 g/L, % | 90% | 97%, 99% | 97%, 99%, 100% |

TABLE 2a-continued

| Enzymatic Acid Detergents | | | | |
|---|---|---|---|---|
| Average Milk Soil Load, mg | — | 11 | 13 | |
| Soil Load on the Control, mg | — | 11 | 11 | |
| | Formulation | | | |
| Ingredients | 19 | 20 | 21 | 22 |
| Deionized Water | 28 | 59 | 64 | 39 |
| Anhydrous Citric Acid | 20 | 10 | 10 | 20 |
| Phosphoric Acid (75%) | 20 | 10 | 10 | 20 |
| Sulfamic Acid | 0 | 0 | 0 | 0 |
| Sulfuric Acid | 0 | 0 | 0 | 0 |
| Triton DF-12 (NI Surfactant) | 2 | 1 | 1 | 1 |
| Capric/Caprylic Acid (40/60) | 5 | 2 | 0 | 2 |
| Propylene Glycol | 2 | 2 | 2 | 2 |
| Sodium Octyl Sulphonate | 13 | 10 | 10 | 10 |
| Vallidase AFP 2000 SAPU(P) | — | — | 3 | — |
| Vallidase AFP 1000 SAPU(L) | 10 | 6 | — | 6 |
| pH: Neat (° C.) | — | — | — | — |

TABLE 2a-continued

| Enzymatic Acid Detergents | | | | |
|---|---|---|---|---|
| pH: 2 g/L (Deionized Water, ° C.) | — | — | — | — |
| pH: 5 g/L (Deionized Water, ° C.) | — | — | — | — |
| pH: 2 g/L (400 ppm, ° C.) | 2.80(22) | — | — | — |
| pH: 5 g/L (400 ppm, ° C.) | — | — | — | — |
| pH: 1 g/L (400 ppm, ° C.) | — | — | — | — |
| pH: 2 g/L (400 ppm, ° C.) | 3.05(54)/ 2.96 | — | — | — |
| pH: 5 g/L (400 ppm, ° C.) | — | | 2.78(59) | 2.40(53) |
| Cleaning Performance | — | | — | — |
| Usage Concentration, g/L | 2 g/L | | 5 g/L | 5 g/L |
| Wash Temperature, ° C. | 57/55 | | 54 | 56 |
| Milk Soil Cleaning/400 ppm, % | 79, 68 | | 86 | 92 |
| Dinamate Control @ 2 g/L, % | 96, 99 | | 100 | 100 |
| Average Milk Soil Load, mg | 8 | | 20 | 16 |
| Soil Load on the Control, mg | 11 | | 20 | 20 |

TABLE 2b

| Enzymatic Acid Detergents | | | | | | | | |
|---|---|---|---|---|---|---|---|---|
| | Formulation | | | | | | | |
| Ingredients | 23 | 24 | 25 | 26 | 27 | 28 | 29 | 30 |
| Deionized Water | 32 | 32 | 57 | 57 | 57 | 57 | 62 | 62 |
| Anhydrous Citric Acid | 10 | 10 | 15 | 10 | 5 | 15 | 5 | 10 |
| Phosphoric Acid (75%) | 10 | 10 | 5 | 10 | 15 | 5 | 10 | 5 |
| Triton DF-12 (NI Surfactant) | 1 | 1 | 1 | 1 | 1 | 1 | 1 | 1 |
| Capric/Caprylic Acid (40/60) | 2 | 2 | 2 | 2 | 2 | 2 | 2 | 2 |
| Sodium Octyl Sulphonate | — | — | — | 12 | 13.5 | 12 | 13.5 | 13.5 |
| Sodium Xylene Sulphonate | 35 | 35 | 36 | — | — | — | — | — |
| $CaCl_2$ | 2 | 2 | 2 | 2 | 2 | 2 | 2 | 2 |
| Propylene Glycol | 2 | 2 | 2 | 2 | 2 | 2 | 2 | 2 |
| Vallidase AFP 1000 SAPU(L) | 6 | 6 | 6 | 6 | 6 | 6 | 6 | 6 |
| pH: 5 g/L (400 ppm, ° C.) | 2.84(53) | 2.70(52) | 3.01(53) | 2.84(52) | 2.71(52) | 3.00(54) | 3.00(53) | 3.20(53) |
| Usage Concentration, g/L | 5 g/L | 5 g/L | 5 g/L | 5 g/L | 5 g/L | 5 g/L | 5 g/L | 5 g/L |
| Wash Temperature, ° C. | 55 | 55 | 55 | 55 | 55 | 55 | 55 | 55 |
| Milk Soil Cleaning/400 ppm, % | 79 | 84 | 64 | 74 | 87 | 70 | 77 | 58 |
| Average Milk Soil Load, mg | 35 | 31 | 34 | 35 | 35 | 34 | 32 | 30 |
| Soil Load on the Control, mg | — | — | — | — | — | — | — | — |

TABLE 2c

| Enzymatic Acid Detergents | | | | | | | | | | |
|---|---|---|---|---|---|---|---|---|---|---|
| | Formulation | | | | | | | | | |
| Ingredients | 31 | 32 | 33 | 34 | 35 | 36 | 37 | 38 | 39 | 40 |
| Deionized Water | 73 | 74 | 73 | 74 | 73 | 73 | 68 | 74 | 69 | 75 |
| Sulfamic Acid | 5 | 5 | 5 | 5 | 5 | 0 | 5 | 5 | 0 | 0 |
| Bronopal | 0 | 0 | 2 | 2 | 0 | 0 | 2 | 2 | 0 | 0 |
| Anhydrous Citric Acid | 5 | 5 | 5 | 5 | 5 | 10 | 5 | 5 | 5 | 5 |
| Phosphoric Acid (75%) | 15 | 12 | 15 | 15 | 15 | 15 | 15 | 15 | 20 | 20 |
| Glutaraldehyde (50%) | 0 | 0 | 0 | 0 | 2 | 2 | 0 | 0 | 2 | 2 |
| Triton DF-12 (NI Surfactant) | 1 | 0 | 1 | 0 | 1 | 0 | 1 | 1 | 1 | 1 |
| Capric/Caprylic Acid (40/60) | 2 | 2 | 0 | 0 | 0 | 0 | 0 | 0 | 0 | 0 |
| Sodium Octyl Sulphonate | — | — | — | — | — | — | 4 | 4 | 3 | 3 |
| Vallidase AFP 1000 SAPU(L) | 6 | 6 | 6 | 6 | 6 | 6 | 6 | 0 | 6 | 0 |
| pH: 5 g/L (400 ppm, ° C.) | 2.45(55) | 2.45(55) | 3.09(56) | 2.45(55) | 2.54(54) | 2.66(55) | 2.33(55) | 2.31(56) | 2.47(55) | 2.41(56) |
| Usage Concentration, g/L | 5 g/L | 5 g/L | 5 g/L | 5 g/L | 5 g/L | 5 g/L | 5 g/L | 5 g/L | 5 g/L | 5 g/L |
| Wash Temperature, ° C. | 56 | 56 | 57 | 57 | 56 | 56 | 56 | 56 | 56 | 56 |
| Milk Soil Cleaning/400 ppm, % | 88 | 86 | 93 | 92 | 96 | 100 | 85 | 86 | 97 | 87 |
| Dinamate Control @ 2 g/L, % | — | — | — | — | — | — | 97 | 97 | 97 | 97 |
| Average Milk Soil Load, mg | 22 | 22 | 21 | 21 | 25 | 20 | 17 | 19 | 17 | 16 |
| Soil Load on the Control, mg | — | — | — | — | — | — | — | — | — | 18 |

C12-C20 Fatty Alkyl-1,3-Diaminopropane Formulations

Fatty alkyl-1,3-diaminopropane, known also as alkyl-1,3-propylenediamine, alkyl-1,3-propylenediamine, and alkyl-1,3-trimethylenediamine are generally represented by the formula:

$$R—NH—CH_2CH_2CH_2NH_2$$

wherein R is a C4-C22 fatty alkyl radical, and more preferably a C8-C18 fatty alkyl radical.

Figure 2:
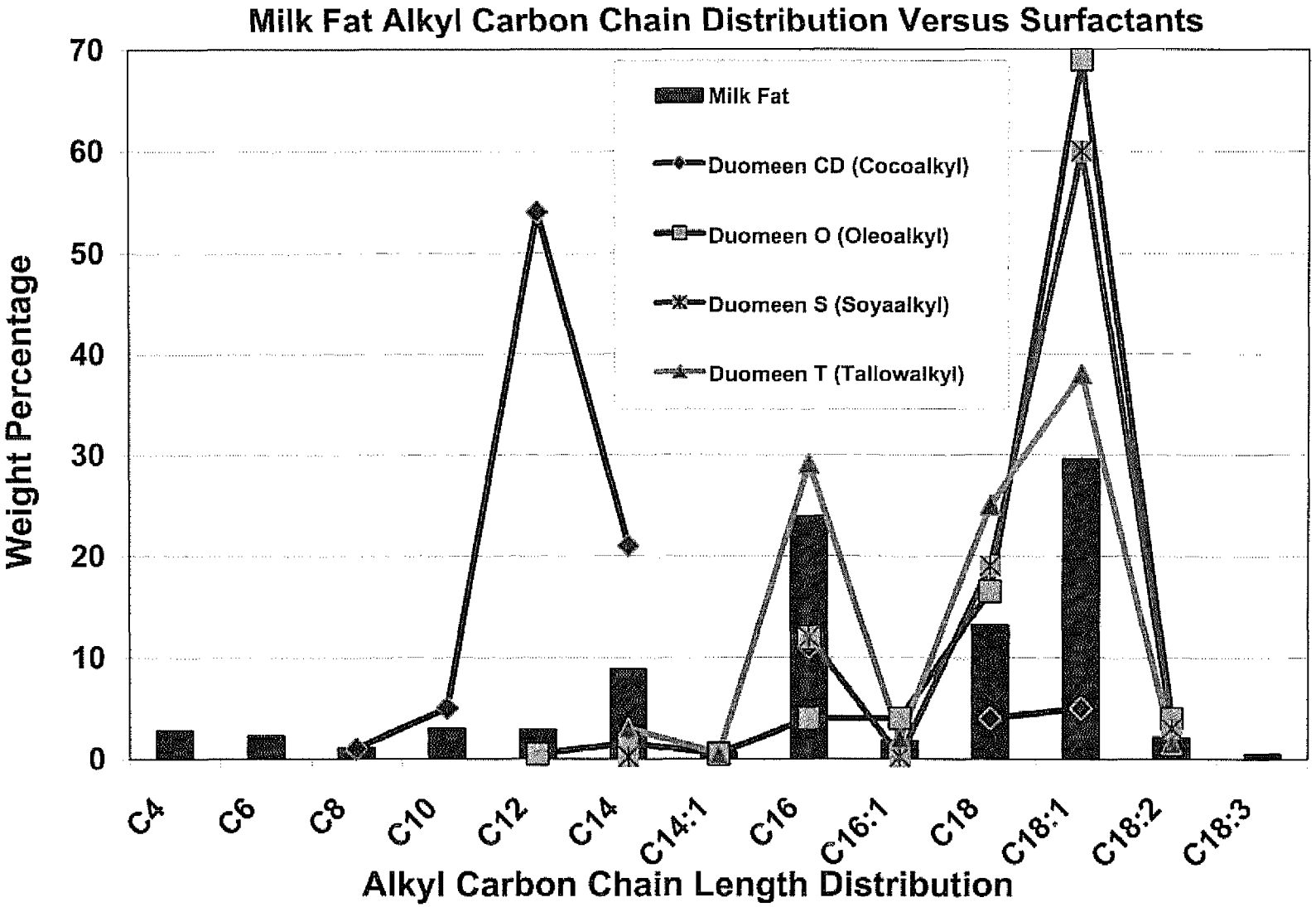
FIG. 2 is a graph showing the alkyl carbon chain distribution of milk fat along with the alkyl carbon chain distribution of various alkyl diaminopropane compositions.

As shown in the following trials, it was discovered that adding a quantity of fatty alkyl-1,3-diaminopropane to the detergent formulations greatly enhanced the cleaning performance thereof in cleaning milk soil and especially in removing protein film. Furthermore, a relationship between the alkyl carbon chain distribution of the diaminopropane compositions and the milk soils cleaning efficiency was discovered. Table 3 shows the alkyl carbon chain distribution for a number of diaminopropane compositions in comparison to the distribution of alkyl carbon chains in milk fat. This comparison is also illustrated in FIG. 2 for several select diaminopropane compositions. It was discovered that the closer the alkyl carbon chain distribution of the diaminopropane composition was to that of milk fat, the more effective it was in cleaning milk soils. Therefore, the most preferred alkyl-1,3-diaminopropanes are those whose alkyl carbon chain distribution closely matches that of milk fat.

expected that these matching 1,3-diaminopropane materials would be highly effective in cleaning milk fat and protein soils. Laboratory cleaning data confirmed the theoretical predictions. The coco-derived 1,3-diaminopropane and its corresponding acetate salt performed acceptably, however, the soya, oleo, and tallow-based 1,3-diaminopropanes and their acetate salts were shown to even further enhance the cleaning performance of the detergent.

It was discovered that even when added in relatively small quantities, the detergents provided excellent cleaning, even outperforming chloroalkaline detergents at temperatures as low as 40° C. Preferably, the amount of alkyl-1,3-diamiopropane present in the acidic detergent compositions ranges from about 0.01-15% by weight alkyl-1,3-diaminopropane, more preferably from about 0.075-10% by weight, even more preferably from about 0.10-8% by weight, and most preferably from about 0.15-6% by weight.

Fatty alkyl-1,3-diaminopropanes can be used as amines or can be converted into diamine salts through a reaction with low allyl carbon acids such as formic acid, acetic acid, or any other organic acids. Mono and diacetate salts of fatty alkyl-1,3-propylenediamines (alone or in combination) are particularly preferred. The mono and diacetate salts are prepared in situ by mixing of the amines with controlled amounts of acetic acid prior to adding any other ingredients.

Preferred diaminopropane compositions are commercially available from Akzo Nobel under the name DUOMEEN. The DUOMEEN family includes Duomeen® C (Coco Alkyl),

TABLE 3

Alkyl Carbon Chains Distribution of Milk Fat/Protein and Fatty Alkyl-1,3-Diaminopropane Alkyl Carbon Chain Distribution (% Weight)

| | C4 | C6 | C8 | C10 | C12 | C14 | C14:1 | C16 | C16:1 | Total C16 | C18 | C18:1 | C18:2 | C18:3 | Total C18 | Theoretical Match |
|---|---|---|---|---|---|---|---|---|---|---|---|---|---|---|---|---|
| Milk Fat Alkyl Carbon Chain | 2.8 | 2.3 | 1.1 | 3 | 2.9 | 8.9 | 0.7 | 24 | 1.8 | 25.8 | 13 | 29.6 | 2.1 | 0.5 | 45 | |
| Duomeen C (Coco Alkyl) | | | 6 | 7 | 51 | 19 | | 9 | | 9 | 2 | 6 | | | 8 | No |
| Duomeen CD (Coco Alkyl) | | | 1 | 5 | 54 | 21 | | 11 | | 11 | 4 | 5 | | | 9 | No |
| Duomeen O (Oleo Alkyl) | | | | | 0.5 | 1.5 | 0.5 | 4 | 4 | 8 | 17 | 69 | 4 | | 89.5 | Borderline Yes |
| Duomeen OL (Oleo Alkyl) | | | | | 0.5 | 1.5 | 0.5 | 5 | 5 | 10 | 8 | 77 | 3 | | 88 | Borderline Yes |
| Duomeen S (Soya Alkyl) | | | | | | 0.2 | | 12 | 0.2 | 12.2 | 19 | 60 | 3 | | 82 | Borderline Yes |
| Duomeen T (Tallow Alkyl) | | | | | | 3 | 0.5 | 29 | 2 | 31 | 25 | 38 | 1.5 | | 64.5 | Yes |
| Duomac T (Tallow Alkyl Diacetates) | | | | | | 3 | 0.5 | 29 | 2 | 31 | 25 | 38 | 1.5 | | 64.5 | Yes |
| Genamin TAP 100 D (Tallow Alkyl) | | | | | | 3 | | 29 | | 29 | 63 | | | | 63 | Yes |
| Genamin SHP 100 (Stearyl Alkyl) | | | | | | 3 | | 29 | | 29 | 63 | | | | 63 | Yes |
| Genamin LAP 100 D (Lauro Alkyl) | | | | 4 | 72 | 21 | | 4 | | 4 | | | | | | No |
| Genamin OLP 100 (Oleo Alkyl) | | | | | 2 | 3 | | 18 | | 18 | 76 | | | | 76 | Yes |

The carbon chain distribution of alkyl groups in milk fat and milk protein ranges from C4 to C18 with the three major components being C14 (9%), C16 (26%), and C18 (45%). When the carbon chain distribution of alkyl groups of milk soil is superimposed along with various diaminopropane compositions as shown in FIG. 2, the coco group falls outside the milk distribution, whereas the oleo, soya and tallow varieties of fatty alkyl-1,3-diaminopropanes fit very well. Based on this matching similarity in carbon chain distribution, it was Duomeen® CD (Distilled Coco Alkyl), Duomeen® S (Soya Alkyl), Duomeen® SV (Soya Alkyl vegetable derived), Duomeen® O (Oleo Alkyl), Duomeen® OL (Oleo Alkyl), Duomeen® T (Tallow Alkyl). These compositions are also available as diacetate salts, a neutralized product formed with acetic acid, such as Duomac® T (Tallow Alkyl diacetate salts) and Anohib® B-101. Additional diaminopropane compositions are available from Clariant under name GENAMIN and includes Genamin® OLP 100 (Oleyl propylenediamine), Genamin® TAP 100 (Tallow Alkyl propylenediamine), Genamin® TAP 100 D (Tallow Alkyl propylenediamine, distilled), Genamin® LAP 100 (Lauryl propylenediamine). Yet additional diaminopropane compositions are available from Corsicana Technologies under the name CORSAMINE, such as Corsamine® DC (Coco Alkyl), Corsamine® DO (Oleyl Alkyl), and Corsamine® DT (Tallow Alkyl).

Table 4 demonstrates the cleaning efficacy of detergent formulations comprising both acidic enzymes and fatty alkyl diaminopropane compositions. As the data shows, these compositions were highly effective in cleaning milk soils.

TABLE 4

Detergent Formulations Comprising Enzyme and Fatty Alkyl Diaminopropane

| | Formulation | | | | | | |
|---|---|---|---|---|---|---|---|
| Ingredients | 41 | 42 | 43 | 44 | 45 | 46 | 47 |
| Deionized Water | 73 | 74 | 70 | 71 | 74 | 77 | 71 |
| Duomeen CD | 2 | 2 | 2 | 2 | 2 | 2 | 2 |
| Acetic Acid | — | — | 2 | 1 | 1 | 1 | 1 |
| Sulfamic Acid | 5 | 5 | 5 | 5 | 5 | 5 | 0 |
| Anhydrous Citric Acid | 5 | 5 | 5 | 5 | 5 | 5 | 5 |
| Phosphoric Acid (75%) | 15 | 15 | 15 | 15 | 15 | 15 | 20 |
| Triton DF-12 (NI Surfactant) | 1 | 1 | 1 | 1 | 1 | 1 | 1 |
| Vallidase AFP 1000 | 6 | 6 | 6 | 6 | 3 | 0 | 6 |
| SAPU(L) | | | | | | | |
| PH: Neat | — | — | 1.07 | 1.02 | — | — | 1.18 |
| pH: 5 g/L (400 ppm, ° C.) | 2.52(56) | 2.53(55) | 2.41(54) | 2.44(56) | 2.42(56) | 2.38(56) | 2.52(55) |
| Usage Concentration, g/L | 5 g/L | 5 g/L | 5 g/L | 5 g/L | 5 g/L | 5 g/L | 5 g/L |
| Wash Temperature, ° C. | 58 | 56 | 54 | 56/58 | 57 | 57 | 55 |
| Milk Soil Cleaning/400 ppm, % | 100 | 98 | 94 | 96/92 | 92 | 92 | 95 |
| Powder Chloroalkaline | — | — | 92 | 92/97 | 97 | 97 | 92 |
| Detergent Control @ 2 g/L, % | | | | | | | |
| Average Milk Soil Load, mg | 24 | 24 | 28 | 27/21 | 19 | 24 | 25 |
| Soil Load on the Control, mg | — | — | 25 | 25/18 | 18 | 18 | 25 |

| | Formulation | | | | | | |
|---|---|---|---|---|---|---|---|
| Ingredients | 48 | 49 | 50 | 51 | 52 | 53 | 54 |
| Deionized Water | 71 | 72 | 73 | 74 | 75 | 76 | 77 |
| Duomeen CD | 1 | 1 | 1 | 1 | 1 | 1 | 1 |
| Acetic Acid | 2 | 2 | 2 | 2 | 2 | 2 | 2 |
| Sulfamic Acid | 5 | 5 | 5 | 5 | 5 | 5 | 5 |
| Anhydrous Citric Acid | 5 | 5 | 5 | 5 | 5 | 5 | 5 |
| Phosphoric Acid (75%) | 15 | 15 | 15 | 15 | 15 | 15 | 15 |
| Triton DF-12 (NI Surfactant) | 1 | 1 | 1 | 1 | 1 | 1 | 1 |
| Vallidase AFP 1000 | 6 | 5 | 4 | 3 | 2 | 1 | 0 |
| SAPU(L) | | | | | | | |
| PH: Neat | — | — | — | — | — | — | — |
| pH: 5 g/L (400 ppm, ° C.) | 2.31(55) | 2.31(55) | 2.32(57) | 2.32(56) | 2.33(56) | 2.33(58) | 2.33(58) |
| Usage Concentration, g/L | 5 g/L | 5 g/L | 5 g/L | 5 g/L | 5 g/L | 5 g/L | 5 g/L |
| Wash Temperature, ° C. | 55 | 55 | 57 | 56 | 57 | 56 | 56 |
| Milk Soil Cleaning/400 ppm, % | 92 | 93 | 90 | 92 | 88 | 90 | 88 |
| Powder Chloroalkaline | 95 | 95 | 95 | 95 | 95 | 95 | 95 |
| Detergent Control @ 2 g/L, % | | | | | | | |
| Average Milk Soil Load, mg | 26 | 29 | 22 | 24 | 23 | 26 | 26 |
| Soil Load on the Control, mg | 32 | 32 | 32 | 32 | 32 | 32 | 32 |

Surfactants

Surfactants are important ingredients in detergents because they impart beneficial properties to the detergents, such as wetting, lowering surface tension, and cleaning assistance. However, many surfactants tend to foam when agitated. In CIP systems, because it is desirable to create as short a wash time as possible, excessive or long lasting foam is highly undesirable. CIP systems are particularly prone to foaming due to the agitation and slug action of the cleaning detergents. Also, protein soils, in general, naturally tend to produce foam. Therefore, it is important in the context of these systems to select surfactants which are non-foaming or very low foaming.

The preferred surface active agents used with the present detergent formulations include anionic, nonionic, cationic, amphoteric, and zwitterionic surfactants, or mixtures thereof and are stable in highly acidic conditions and in the presence of oxidants such as oxygen bleach and especially peroxide and peroxy acid bleach. Particularly preferred water soluble organic anionic surfactants include amine oxide, phosphine oxide, sulphoxide, sulfonate, sulfate, and betaine surfactants. One especially preferred class of anionic surfactants include the linear or branched alkali metal mono- and/or di-(C8-C14) alkyl diphenyl oxide mono- and/or disulfonates, available from Dow Chemical Company under the name DOWFAX. Other preferred anionic surfactants include the primary alkyl sulfates, alkyl sulfonates, arylalkylsulfonates and secondary alkylsulfonates. Exemplary anionic surfactants include sodium (C10-C18) alkylsulfonates such as sodium dodecylsulfonate, sodium alkylsulfonates such as sodium hexdecyl-1-sulfonate, and sodium (C12-C18) alkylbenzenesulfonates such as sodium dodecylbenzenesulfonate. The corresponding potassium salts of the foregoing can also be used.

Nonionic surfactants tend to lower the detergent surface tension, improve the wettability of the surface being cleaned, and solubilize the soils in the inventive detergents. Preferred nonionic surfactants include capped or uncapped poly-lower alkoxylated higher alcohols or ether derivatives thereof, in which the alcohol or ether contains 9 to 18 carbon atoms and the number of moles of lower alkylene oxide (2 or 3 carbon atoms) is from 3 to 12.

Exemplary alkyl alkoxylated alcohols or ethers suitable for use with the present invention include the water soluble or dispersible nonionic surfactants from BASF under the name PLURAFAC (Fatty alcohol alkoxylates), and LUTENOL (fatty alcohol ethoxylates). These surfactants generally comprise the reaction product of a higher linear alcohol and a mixture of propylene and ethylene oxides. Specific examples include a (C13-C15) fatty alcohol condensed with 6 moles of ethylene oxide and 3 moles of propylene oxide and a (C13-C15) fatty alcohol condensed with 7 moles of propylene oxide and 4 moles of ethylene oxide.

Preferred PLURAFAC surfactants include Plurafac® LF-303 (polyglycol ether), Plurafac® LF-305 (C8-C14 alkyl chain), Plurafac® S-305LF, Plurafac® SLF-18B (C6-C10 ethoxylated linear alcohol), Plurafac® SLF-18B45, Plurafac® LF-4030. Other exemplary nonionic surfactants include those by Shell Chemical Company under the name NEODOL. These surfactants are condensation products of a mixture of higher fatty alcohols averaging about 12 to 15 carbon atoms with about 6-7 moles of ethylene oxide. Yet additional exemplary nonionic surfactants include those from Union Carbide under the names TERGITOL and TRITON, and the low foaming, biodegradable alkoxylated linear fatty alcohols by BASE under the name POLY-TERGENT.

Other exemplary surfactants that may be used in the present invention are the alkylpolysaccharide surfactants having a hydrophobic group containing from about 8-20 carbon atoms. Preferably, these surfactants comprise from about 10 to 16 carbon atoms (about 12-14 most preferably) and from about 1.5-10 saccharide units (i.e., fructosyl, glucosyl and galactosyl units and mixtures thereof). Preferred alkylpolysaccharide surfactants for use with the present invention include alkylpolyglucoside surfactants by Henkel Corporation under the name APG. These APG surfactants are characterized by the general formula $(C_nH_{2n}+1)O(C_6H_{10}O_5)_xH$.

Cationic surfactants for use with die present invention include those comprising amino or quaternary ammonium hydrophilic moieties that are positively charged when dissolved in the inventive detergents. Preferred quaternary ammonium surfactants are quaternary ammonium salts including dialkyldimethylammonium chlorides and trialkylmethylammonium chlorides, wherein the alkyl groups comprise from about 10-22 carbon atoms and are derived from long chain fatty acids, such as hydrogenated tallow fatty acids, coconut fatty acids, oleo fatty acids, soya fatty acids. Exemplary quaternary ammonium salts include ditallowedimethylammonium chloride and ditallowmethylammonium chloride. Salts of primary, secondary, and tertiary fatty amines may also be used as the cationic surfactant in the inventive detergents. Preferably, the alkyl groups of such amines comprise from about 10-22 carbon atoms and may be substituted or unsubstituted. Secondary and tertiary amines are particularly preferred, with tertiary amines being most preferred. Exemplary amines include stearamidopropyldimethyl amine, diethylaminoethyl stearamide, dimethyl stearamine, myristyl amine, and ethoxylated stearylamine. Preferably, the amine salts are selected from the group consisting of halogen, acetate, phosphate, nitrate, citrate, lactate and alkyl sulfate amine salts.

Amphoteric surfactants for use with the present invention include those broadly described as derivatives of aliphatic secondary and tertiary amines in which the aliphatic radical is straight or branched chain and wherein one of the aliphatic radicals comprises from about 6-18 carbon atoms and another of the aliphatic radicals includes an anionic hydrophilic group such as a carboxylate, sulfonate, sulfate, phosphate, or phosphonate. Exemplary amphoteric surfactants include sodium 3-decylaminopropionate, sodium 3-decylaminopropane sulfonate, sodium lauryl sarcosinate, and N-alkyltaurines such as those derived from dodecylamine and sodium isethionate.

Zwitterionic surfactants for use with the present invention include those derived from aliphatic quaternary ammonium, phosphonium, and sulfonium compounds, in which the aliphatic radicals are straight or branched chain, and wherein at least one of the aliphatic groups contains from about 8-18 carbon atoms and one anionic group selected from carboxylate, sulfonate, sulfate, phosphate, or phosphonate.

Preferably, compositions according to the present invention comprise from about 0-15% by weight of a surfactant, more preferably from about 0.10-15% by weight, even more preferably from about 0.50-10% by weight, still more preferably from about 1.0-8% by weight, and most preferably, from about 2-6% by weight. Mixtures of two or more surface active agents may be used in the inventive detergent compositions, and as explained below, such multiple surfactant systems are preferred.

Table 5 sets forth several diaminopropane detergent formulations including various preferred surfactants.

TABLE 5

Fatty Alkyl Diaminopropane Detergent Formulations with Added Surfactant(s)

| | Formulations | | | | | | | | | | | | |
|---|---|---|---|---|---|---|---|---|---|---|---|---|---|
| Ingredients | 55 | 56 | 57 | 58 | 59 | 60 | 61 | 62 | 63 | 64 | 65 | 66 | 67 |
| Deionized Water | 38 | 27 | 46.5 | 48 | 45 | 46 | 46 | 48 | 48 | 48 | 47 | 47 | 47 |
| Acetic Acid | — | — | 1.5 | — | 1 | 1 | 1 | — | — | — | — | — | — |
| Duomeen T | — | — | — | 2 | — | — | — | — | — | — | — | — | — |
| Duomeen O | — | — | 3 | — | — | — | — | — | — | — | — | — | — |
| Duomeen S | — | — | — | — | 2 | 2 | 2 | — | — | — | — | — | — |
| Plurafac SLF-18B | 2 | 2 | — | — | — | — | — | — | — | — | — | — | — |
| Plurafac LF-303 | — | — | — | 2 | 2 | 1 | — | — | 2 | — | — | 3 | — |
| Plurafac S-305LF | — | — | — | — | — | — | 1 | — | — | — | 3 | — | — |
| Plurafac LF-305 | — | — | — | — | — | — | — | 2 | — | 2 | — | — | 3 |
| Plurafac LF-4030 | — | — | 3 | — | — | 2 | 2 | — | — | — | — | — | — |
| Anhydrous Citric Acid | 3 | 3 | 3 | 3 | 3 | 3 | 3 | 3 | 3 | 3 | 3 | 3 | 3 |
| Phosphoric Acid (85%) | 43 | 43 | 43 | 43 | 43 | 43 | 43 | 43 | 43 | 43 | 43 | 43 | 43 |

TABLE 5-continued

| Fatty Alkyl Diaminopropane Detergent Formulations with Added Surfactant(s) | | | | | | | | | | | | | |
|---|---|---|---|---|---|---|---|---|---|---|---|---|---|
| | Formulations | | | | | | | | | | | | |
| Ingredients | 55 | 56 | 57 | 58 | 59 | 60 | 61 | 62 | 63 | 64 | 65 | 66 | 67 |
| Sodium Octyl Sulphonate | 9 | 21 | — | — | — | — | — | — | — | — | — | — | — |
| Sodium Hydrogen Sulphate | 5 | 2 | — | — | 2 | 2 | 2 | 2 | 2 | 2 | 2 | 2 | 2 |
| Ventocil P (20%) | — | 2 | — | 2 | 2 | 2 | 2 | 2 | 2 | 2 | 2 | 2 | 2 |
| Phase/Homogeneity | 1 Phase | 1 Phase | 1 Phase | 2 Phase | 2 Phase | 2 Phase | 2 Phase | 2 Phase | 1 Phase | 1 Phase | 2 Phase | 1 Phase | 1 Phase |
| Cleaning Performance, % | 99.3 | 98.3 | 99.7 | 99.3 | 98.6 | 98.7 | 99.1 | — | — | — | — | — | — |
| Germicidal Efficacy, EN1040 | | | | | | | | | | | | | |
| *Pseudomonas* (0.5%, 5 log) | P | P | P | — | — | — | — | — | — | — | — | — | — |
| *Staph. Aureus* (0.5%, 5 log) | 1% | 2% | 2% | — | — | — | — | — | — | — | — | — | — |

Detergent Foam Test (Dairy Pipe Line-CIP Cleaning System)

Detergent foaming is a concern especially for systems in which quick cleaning and rinsing cycles are important, particularly CIP systems having wash cycles of about 6-8 minutes. A series of trials were performed in order to optimize the level of foaming associated with the detergent formulations (i.e., reduce the level of foaming as much as possible).

The foaming trials were performed in a dynamic environment using a calibrated 500 cc tall gas washing bottle fitted with a fritted glass gas dispersion tube and cap (Corning 31770 F-34 Series), a F&P Precision Bore Flowrator Tube #01-150/S-51801, and a GE model 5KH32EG115X air pump. Flexible tubing was connected from the outlet of the air pump through the flowrator tube and into the inlet of the fritted glass gas dispersion tube. The detergent solution was prepared and 100 mL was decanted into the calibrated gas washing bottle and capped off. The air pump was set for a flow rate of 2.0 L/min and activated for 15 seconds. The initial net volume of foam (total volume minus the volume of liquid) was recorded. Measurements were periodically taken until complete foam collapse was achieved.

The tests were performed using both 400 ppm hard water (HD) and deionized water (DIW). Initially, a variety of single and dual surfactant systems were tested. These results are shown in Tables 6-8. As used herein, DNMC stands for dynamic foam height measured in mL in a dynamic foam height measurement.

TABLE 6

| Fatty Alkyl Diaminopropane Detergent Formulations with Single and Dual Surfactant | | | | | | | | | |
|---|---|---|---|---|---|---|---|---|---|
| Ingredients | 68 | 69 | 70 | 71 | 72 | 73 | 74 | 75 | 76 |
| Deionized Water | 43 | 43 | 43 | 43 | 43 | 43 | 43 | 43 | 43 |
| Acetic Acid | 1 | 1 | 1 | 1 | 1 | 1 | 1 | 1 | 1 |
| Duomeen S | 1 | 1 | 1 | 1 | 1 | 1 | 1 | 1 | 1 |
| Plurafac LF-303 | — | — | — | — | — | 2 | — | — | — |
| Triton DF-12 | — | — | 2 | — | — | — | — | 2 | — |
| Tergitol MDS-42 | — | — | — | 2 | — | — | — | — | 2 |
| Plurafac LF-4030 | — | — | — | — | — | — | — | — | — |
| Plurafac SLF-18B | — | — | — | — | 2 | — | — | — | — |
| Plurafac LF-305 | 4 | — | 2 | 2 | 2 | 2 | 2 | — | — |
| Plurafac S-305LF | — | 4 | — | — | — | — | 2 | 2 | 2 |
| Anhydrous Citric Acid | 3 | 3 | 3 | 3 | 3 | 3 | 3 | 3 | 3 |
| Phosphoric Acid (85%) | 43 | 43 | 43 | 43 | 43 | 43 | 43 | 43 | 43 |
| Sodium Octyl Sulfonate | — | — | — | — | — | — | — | — | — |
| Lactic Acid | 5 | 5 | 5 | 5 | 5 | 5 | 5 | 5 | 5 |
| Homogeneity-Initial | Clear | Clear | Clear | Clear | Clear | Clear | Clear | Clear | Clear |
| Two Days/Ambient | Clear | Floc | Haze | Floc | Clear | Floc | Haze | Floc | Floc |
| Cleaning %, 4-Min/ 40° C./Control | — | — | — | — | — | — | — | — | 98.0/36.6 |
| | Foam Vol + 300 mL 40° C. | | | | | | | | |
| DNMC-Deionized Water (0-5 min) | 230-40 | 180-10 | 240-40 | 240-40 | 300-50 | 290-60 | 300-30 | 280-20 | 330-10 |
| | 340-50 | 400-0 | 430-30 | 430-40 | 390-60 | 390-110 | 410-40 | 400-20 | 390-0/4.3 |

TABLE 6-continued

Fatty Alkyl Diaminopropane Detergent Formulations with Single and Dual Surfactant

| | | | | | | | | | |
|---|---|---|---|---|---|---|---|---|---|
| DNMC-HD Water (0-5 min) | 250-50 | 230-3.5 | 250-40 | 280-40 | 330-70 | 310-40 | 330-40 | 340-30 | 370-0/3.3 |
| | 330-60 | 340-4.3 | 420-50 | 400-30 | 340-150 | 290-50 | 420-30 | 410-20 | 350-0/3.5 |

| Ingredients | 77 | 78 | 79 | 80 | 81 | 82 | 83 | 84 |
|---|---|---|---|---|---|---|---|---|
| Deionized Water | 43 | 43 | 43 | 43 | 43 | 43 | 43 | 43 |
| Acetic Acid | 1 | 1 | 1 | 1 | 1 | 1 | 1 | 1 |
| Duomeen S | 1 | 1 | 1 | 1 | 1 | 1 | 1 | 1 |
| Plurafac LF-303 | — | 2 | 2 | 4 | — | — | — | — |
| Triton DF-12 | — | — | — | — | 2 | 4 | — | — |
| Tergitol MDS-42 | — | — | — | — | — | — | 2 | 4 |
| Plurafac LF-4030 | — | — | 2 | — | 2 | — | 2 | — |
| Plurafac SLF-18B | 2 | — | — | — | — | — | — | — |
| Plurafac LF-305 | — | — | — | — | — | — | — | — |
| Plurafac S-305LF | 2 | 2 | — | | — | — | — | — |
| Anhydrous Citric Acid | 3 | 3 | 3 | 3 | 3 | 3 | 3 | 3 |
| Phosphoric Acid (85%) | 43 | 43 | 43 | 43 | 43 | 43 | 43 | 43 |
| Sodium Octyl Sulfonate | — | — | — | — | — | — | — | — |
| Lactic Acid | 5 | 5 | 5 | 5 | 5 | 5 | 5 | 5 |
| Homogeneity-Initial | Clear | Clear | Clear | Clear | Clear | Clear | Clear | Clear |
| Two Days/Ambient | Floc | Haze | Clear | Floc | Clear | Clear | Cleaar | Floc |
| Cleaning %, 4-Min/40° C./Control | — | 97.0/36.6 | — | — | — | — | — | — |
| | | | Foam Vol + 300 mL 40° C. | | | | | |
| DNMC-DI Water (0-5 min) | 340-30 | 330-1.5 | 260-130 | 160-30 | 260-50 | 300-40 | 340-90 | 290-30 |
| | 370-30 | 340-2.8 | 260-140 | 220-20 | 320-60 | 310-30 | 320-60 | 280-50 |
| DNMC-HD Water (0-5 min) | 350-40 | 340-2.0 | 250-130 | 190-20 | 300-110 | 340-40 | 340-190 | 370-40 |
| | 400-40 | 370-3.0 | 300-170 | 240-20 | 310-140 | 320-40 | 290-120 | 300-30 |

| Ingredients | 85 | 86 | 87 | 88 | 89 | 90 | 91 | 92 |
|---|---|---|---|---|---|---|---|---|
| Deionized Water | 42 | 43 | 43 | 43 | 43 | 43 | 43 | 43 |
| Acetic Acid | 1 | 1 | 1 | 1 | 1 | 1 | 1 | 1 |
| Duomeen S | 1 | 1 | 1 | 1 | 1 | 1 | 1 | 1 |
| Plurafac LF-303 | 2 | 2 | — | — | — | 2 | — | — |
| Triton DF-12 | 2 | — | 2 | — | — | — | 2 | — |
| Tergitol MDS-42 | — | 2 | 2 | — | — | — | — | 2 |
| Plurafac LF-4030 | — | — | — | 2 | — | — | — | — |
| Plurafac SLF-18B | — | — | — | 2 | 4 | 2 | 2 | 2 |
| Plurafac LF-305 | — | — | — | — | — | — | — | — |
| Plurafac S-305LF | — | — | — | — | — | — | — | — |
| Anhydrous Citric Acid | 3 | 3 | 3 | 3 | 3 | 3 | 3 | 3 |
| Phosphoric Acid (85%) | 43 | 43 | 43 | 43 | 43 | 43 | 43 | 43 |
| Sodium Octyl Sulfonate | — | — | — | — | — | — | — | — |
| Lactic Acid | 5 | 5 | 5 | 5 | 5 | 5 | 5 | 5 |
| Homogeneity-Initial | Clear | Clear | Clear | Clear | Clear | Clear | Clear | Clear |
| Two Days/Ambient | Haze | Floc | Haze | Clear | Clear | Floc | Clear | Haze |
| Cleaning %, 4-Min/40° C./Control | — | 95.8/36.6 | — | — | — | — | — | — |
| | | | Foam Vol + 300 mL 40° C. | | | | | |
| DNMC-DI Water (0-5 min) | 350-50 | 340-3.5 | 420-40 | 380-190 | 400-360 | 280-130 | 290-30 | 280-200 |
| | 310-40 | 230-3.0 | 310-30 | 300-150 | 300-200 | 220-90 | 280-30 | 240-190 |
| DNMC-HD Water (0-5 min) | 380-20 | 350-2.0 | 420-20 | 370-160 | 360-300 | 310-50 | 310-40 | 260-170 |
| | 380-96 | 260-2.0 | 310-30 | 320-140 | 300-180 | 230-40 | 260-40 | 230-120 |

TABLE 7

Fatty Alkyl Diaminopropane Detergent Formulations with Single Surfactant

| | Formulations | | | | | | | | |
|---|---|---|---|---|---|---|---|---|---|
| Ingredients | 93 | 94 | 95 | 96 | 97 | 98 | 99 | 100 | 101 |
| Deionized Water | 50 | 48 | 47 | 45 | 44 | 42.5 | 46 | 43 | 46.5 |
| Acetic Acid | — | — | 1 | 1 | 1 | 1.5 | — | 1 | 1.5 |

TABLE 7-continued

Fatty Alkyl Diaminopropane Detergent Formulations with Single Surfactant

| Ingredients | Formulations | | | | | | | | |
|---|---|---|---|---|---|---|---|---|---|
| | 93 | 94 | 95 | 96 | 97 | 98 | 99 | 100 | 101 |
| Duomeen CD | — | — | — | — | — | — | — | — | — |
| Duomeen O | — | — | 2 | 2 | 2 | 3 | — | — | 3 |
| Duomac T (Diacetates) | 2 | 2 | — | — | — | — | 3 | 3 | — |
| Plurafac SLF-18B45 | — | 2 | — | — | — | — | — | — | — |
| Sodium Octane Sulfonate | — | — | — | — | — | — | — | — | — |
| Citric Acid (Anhydrous) | 3 | 3 | 3 | 3 | 3 | 3 | 3 | 3 | 3 |
| Phosphoric Acid (85%) | 43 | 43 | 43 | 43 | 43 | 43 | 43 | 43 | 43 |
| Sodium Bisulfate | — | 2 | 2 | 2 | 2 | 2 | — | 2 | — |
| Ventocil P | 2 | 2 | 2 | 2 | 2 | 2 | 2 | 2 | — |
| Plurafac LF-4030 | — | — | — | 2 | 3 | 3 | 3 | 3 | 3 |
| Cleaning % (8 Min @ 60° C.) | 99.5 | 98.8 | 99.9 | 99.7 | 98.9 | 99.7 | 99.5 | 99.8 | 99.7 |
| Foam mL, 40° C.(0-20 min), DIW | 245-224 | 249-125 | 300-285 | 155-140 | 150-140 | 195-175 | 155-110 | 145-130 | 320-185 |
| Foam mL, 40° C.(0-20 min), DIW | 260-225 | 230-195 | 320-310 | 225-200 | 200-195 | 220-190 | 220-130 | 155-130 | 320-185 |
| Foam mL, 22° C.(0-20 min), DIW | 200-175 | 225-175 | 235-220 | 145-125 | 185-150 | 185-150 | 150-125 | 145-125 | 315-220 |
| Foam mL, 22° C.(0-20 min), DIW | 200-180 | 210-165 | 280-275 | 175-160 | 225-180 | 215-180 | 190-150 | 165-135 | 295-200 |

TABLE 8

Evaluation of Fatty Alkyl Diaminopropane Detergents With Defoaming Non-ionic Surfactants

| Ingredients | Formulations | | | | | | | | | | | |
|---|---|---|---|---|---|---|---|---|---|---|---|---|
| | 102 | 103 | 104 | 105 | 106 | 107 | 108 | 109 | 110 | 111 | 112 | 113 |
| Deionized Water | 45 | 45 | 48 | 48 | 45 | 45 | 45 | 45 | 45 | 45 | 45 | 45 |
| Acetic Acid | 1 | 1 | — | — | 1 | 1 | 1 | 1 | 1 | 1 | 1 | 1 |
| Duomeen CD | 2 | 2 | — | — | — | — | — | — | — | — | — | — |
| Duomac T (Diacetates) | — | — | 2 | 2 | — | — | — | — | — | — | — | — |
| Duomeen O | — | — | — | — | 2 | 2 | — | — | — | — | — | — |
| Duomeen OL | — | — | — | — | — | — | 2 | 2 | — | — | — | — |
| Duomeen S | — | — | — | — | — | — | — | — | 2 | 2 | — | — |
| Duomeen T | — | — | — | — | — | — | — | — | — | — | 2 | 2 |
| Plurafac LF-303 | 2 | — | 2 | — | 2 | — | 2 | — | 2 | — | 2 | — |
| Plurafac S-305 LF | — | 2 | — | 2 | — | 2 | — | 2 | — | 2 | — | 2 |
| Citric Acid (Anhydrous) | 3 | 3 | 3 | 3 | 3 | 3 | 3 | 3 | 3 | 3 | 3 | 3 |
| Phosphoric Acid (85%) | 43 | 43 | 43 | 43 | 43 | 43 | 43 | 43 | 43 | 43 | 43 | 43 |
| Sodium Bisulfate | 2 | 2 | — | — | 2 | 2 | 2 | 2 | | | | |
| Ventocil P | 2 | 2 | 2 | 2 | 2 | 2 | 2 | 2 | | | | |
| D. Foam mL, 40° C. (0-5 min), DIW | 880-820 | 860-820 | 860-460 | 860-450 | 890-850 | 870-820 | 900-860 | 890-850 | | | | |

Based on the above results, it was noted that for some of the detergent formulations using a dual surfactant system, the foaming was less than compared with single surfactant systems of either of the two surfactant components. This principle was tested and it was surprisingly and unexpectedly discovered that a synergistic defoaming action was achieved using two nonionic surfactants.

Figure 3:
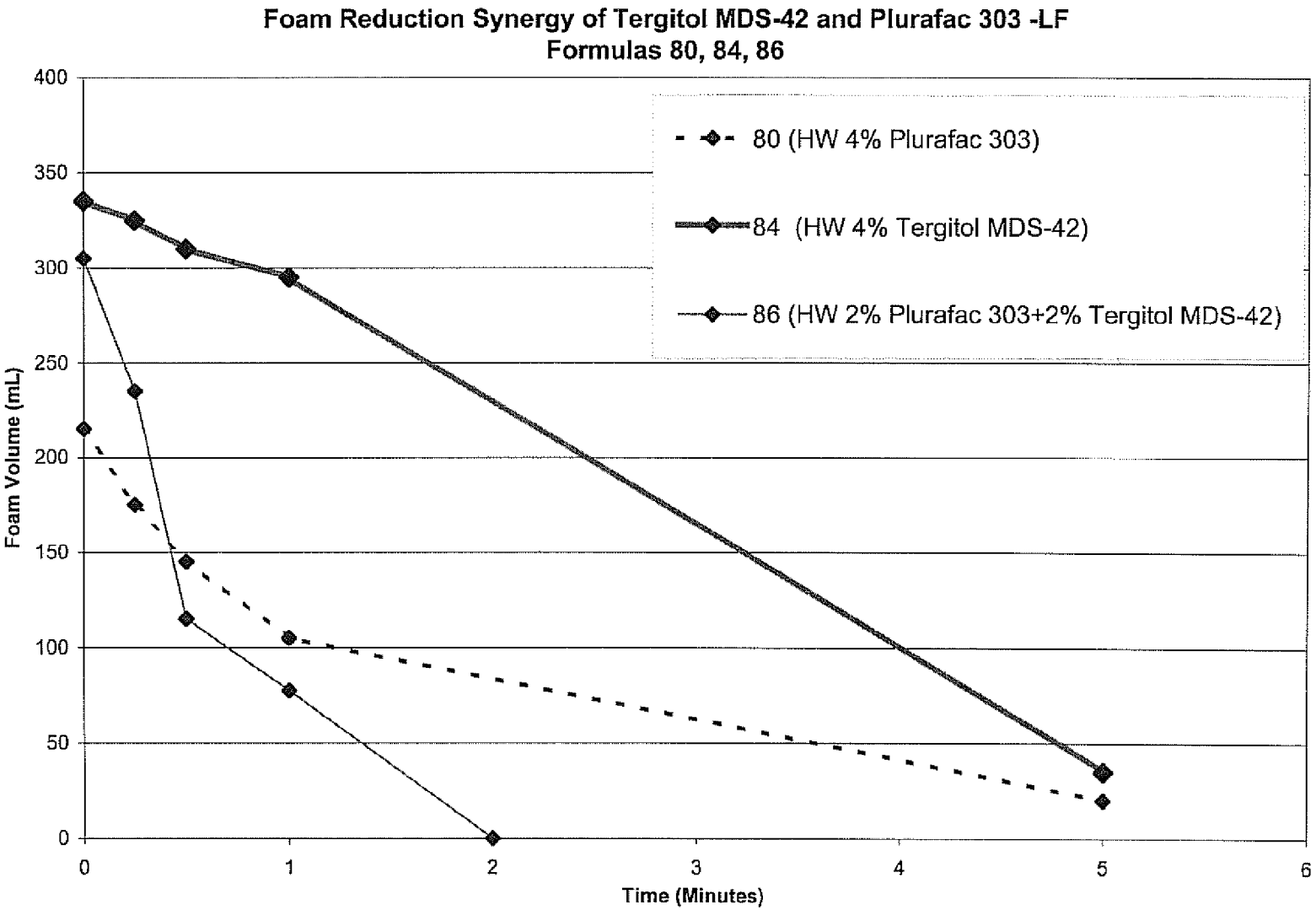
FIG. 3 is a graph showing the synergistic effect of two preferred surfactants in reducing detergent foaming.
Figure 4:
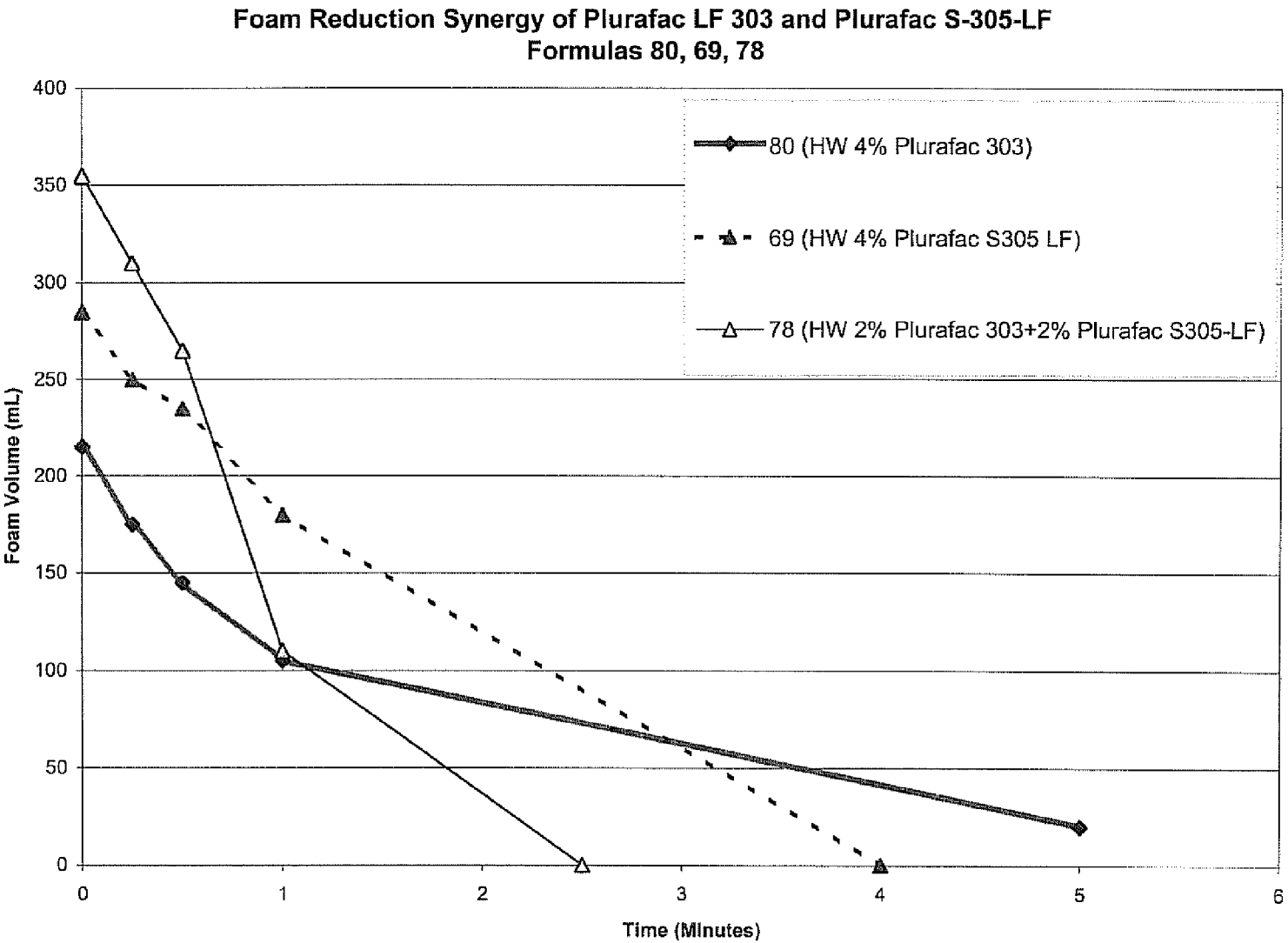
FIG. 4 is a graph showing the synergistic effect of two additional preferred surfactants in reducing detergent foaming.

FIGS. 3 and 4 depict exemplary dual surfactant systems which show that not only does the foam disappear in less total time, the initial foam dissipation occurs more rapidly. FIG. 3 shows three exemplary detergent formulations: one comprising 4% Plurafac® LF-303, one comprising 4% Plurafac® S305 LF, and one comprising 2% of both the former and the latter. In a dynamic foam test at a temperature of 40° C. using a 0.5% concentration of detergent in hard water, the foam reduction time with the dual surfactant system is almost half of that of either of the single surfactant detergents. The trial shown in FIG. 4 was almost identical as that of FIG. 3 except that the Plurafac® S305-LF was replaced with Tergitol® MDS-42. In this trial, the foam reduction time for the dual surfactant system was more than cut in half when compared to the single surfactant detergents. Therefore, a synergy of lowering foam forms when a mixture of two surfactants were used in acid cleaners.

Tables 9-10 depict several preferred dual surfactant detergents in accordance with the present invention.

In addition, several formulations noted in Table 10 comprise the lower alkanesulfonic acid methanesulfonic acid, $CH_3SO_3H$. Methanesulfonic acid is a strong organic acid (pKa=−1.9) distinguished by a particularly high capacity for solvating numerous heavy metals. It was discovered that the addition of methanesulfonic acid to the detergent formulations greatly improved the cleaning performance of the detergent, especially in removing protein films. Methanesulfonic acid and its metal salts are highly soluble in water, and less corrosive than other strong inorganic acids. Methanesulfonic acid is biodegradable and recyclable. Methanesulfonic acid is generally less toxic than fluoroboric acid and fluorosilicic acid.

Methanesulfonic acid in aqueous solution assists in solubilizing of metal salts and surface active agents and has a low tendency to oxidize organic compounds.

Other lower alkyl ($C_1$-$C_{16}$) carbon chain sulfonic acids may be used in the inventive detergent formulations. In addition to methanesulfonic acid, other preferred lower alkyl sulfonic acids include ethanesulfonic acid, propanesulfonic acid, and butanesulfonic acid.

Preferably, acid detergent compositions in accordance with the present invention comprise between about 0-40% by weight of a lower alkyl sulfonic acid, more preferably from about 1-30% by weight, even more preferably from about 2-25% by weight, and most preferably from about 5-20% by weight.

TABLE 9

Fatty Alkyl Diaminopropane Detergent Formulations with Dual Surfactant

| | Formulations | | | | | | | | | | | |
|---|---|---|---|---|---|---|---|---|---|---|---|---|
| Ingredients | 114 | 115 | 116 | 117 | 118 | 119 | 120 | 121 | 122 | 123 | 124 | 125 |
| Deionized Water | 37 | 37 | 37.5 | 37.5 | 36.5 | 36.5 | 36 | 36 | 37.5 | 37 | 36.5 | 36 |
| Acetic Acid | 1 | 1 | 1 | 1 | 1 | 1 | 1 | 1 | 1 | 1 | 1 | 1 |
| Duomeen S | 1 | 1 | 0.5 | 0.5 | 1.5 | 1.5 | 2 | 2 | 0.5 | 1 | 1.5 | 2 |
| Plurafac LF-303 | 2 | 2 | 2 | 2 | 2 | 2 | 2 | 2 | — | — | — | — |
| Tergitol MDS-42 | 2 | — | 2 | — | 2 | — | 2 | — | 2 | 2 | 2 | 2 |
| Plurafac S-305LF | — | 2 | — | 2 | — | 2 | — | 2 | 2 | 2 | 2 | 2 |
| Anhydrous Citric Acid | 4 | 4 | 4 | 4 | 4 | 4 | 4 | 4 | 4 | 4 | 4 | 4 |
| Phosphoric Acid (85%) | 50 | 50 | 50 | 50 | 50 | 50 | 50 | 50 | 50 | 50 | 50 | 50 |
| Lactic Acid | 3 | 3 | 3 | 3 | 3 | 3 | 3 | 3 | 3 | 3 | 3 | 3 |
| Homogeneity-Initial | Clear | Clear | Clear | Clear | Clear | Clear | Clear | Clear | Clear | Clear | Clear | Clear |
| Two Days/Ambient T | Clear | Clear | Clear | Clear | Clear | Clear | Clear | Clear | Clear | Clear | Clear | Clear |

| | Formulations | | | | | | | | |
|---|---|---|---|---|---|---|---|---|---|
| Ingredients | 126 | 127 | 128 | 129 | 130 | 131 | 132 | 133 | 134 |
| Deionized Water | 43 | 43 | 43 | 43 | 43 | 43 | 43 | 43 | 43 |
| Acetic Acid | 1 | 1 | 1 | 1 | 1 | 1 | 1 | 1 | 1 |
| Duomeen S | 1 | 1 | 2 | 2 | 1.5 | 1.5 | 2 | 1 | 1 |
| Plurafac LF-303 | 1 | 3 | 2 | 1 | 1.5 | 2 | 1.5 | 2 | 4 |
| Tergitol MDS-42 | 3 | 1 | 1 | 2 | 2 | 1.5 | 1.5 | 2 | — |
| Plurafac S-30LF | — | — | — | — | — | — | — | — | — |
| Anhydrous Citric Acid | 3 | 3 | 3 | 3 | 3 | 3 | 3 | 3 | 3 |
| Phosphoric Acid (85%) | 43 | 43 | 43 | 43 | 43 | 43 | 43 | 43 | 43 |
| Lactic Acid | 5 | 5 | 5 | 5 | 5 | 5 | 5 | 5 | 5 |
| Homogeneity-Initial | 1 Phase | 1 Phase | 1 Phase | 1 Phase | 1 Phase | 1 Phase | 1 Phase | 1 Phase | 1 Phase |
| Homogeneity-Two Days | Haze | Top Ppt | Top Ppt | Top Ppt | Top Ppt | Top Ppt | Top Ppt | Top Ppt | Top Ppt |
| Foam Vol + 300 mL 40° C. | — | — | — | — | — | — | — | — | — |
| DNMC-DI Water (0-5 | 190-10 | 140-0/3.50 | 220-10 | 250-0/1.66 | 38086 | 38106 | 290-20 | 340-0/3.45 | 160-30 |
| min), end time in min | 190-20 | 150-10 | — | 230-0/1.50 | — | — | — | 230-0/3.00 | 220-20 |
| indicates point of total | 240-30 | 150-0/2.33 | 190-20 | 150-0/1.00 | 170-20 | 210-30 | 240-20 | 230-0/2.83 | — |
| foam collapse | — | — | — | 160-0/1.00 | — | — | — | — | — |
| DNMC-HD Water (0-5 | 200-0/3.00 | 200-0/2.50 | 310-30 | 280-0/3.00 | 250.0/3.00 | 250-0/4.00 | 310-40 | 350-0/2.00 | 190-20 |
| min), end time in min | 190-0/2.50 | 280-0/3.50 | — | — | 270-0/3.00 | — | — | 260-0/2.00 | 240-20 |
| indicates point of total | 210-0/2.70 | 210-0/2.00 | 240-20 | 210-0/1.75 | 190-0/1.50 | 190-0 | 220-40 | 200-30 | — |
| foam collapse | — | — | — | — | 190-0/2.33 | — | — | — | — |

TABLE 10

Fatty Alkyl Diaminopropane Detergents with Dual Surfactants

| Ingredients | Formulation Sequence 135 | 136 | 137 | 138 | 139 | 140 |
|---|---|---|---|---|---|---|
| Deinoized Water | 23.85 | 27.1 | 31.1 | 33.35 | 21.85 | 27.1 |
| Acetic Acid | 1 | 0.25 | 0.25 | 0.25 | 1 | 0.25 |
| Genamin TAP 100D | — | — | — | — | — | — |
| Genamin OLP | 0.15 | 0.15 | 0.15 | 0.15 | 0.15 | 0.15 |
| Plurafac LF-303 | 1.5 | 1 | 1 | 1 | 1.5 | 1 |
| Plurafac SLF-18B | — | — | — | — | — | — |
| Plurafac S-305LF | — | — | — | — | 0 | 0 |
| Plurafac LF-305 | 0 | 0 | 1.5 | 1.5 | — | — |
| Plurafac LF-18B45 | 1.5 | 1.5 | 0 | 0 | 1.5 | 1.5 |
| Anhydrous Citric Acid | 3 | 0 | 0 | 0 | 3 | 0 |
| Phosphoric Acid (75%) Food Grade | 35 | 30 | 30 | 30 | 35 | 30 |
| Sodium Xylene Sulfonate (40%) | 28 | 32 | 24 | 22 | 30 | 32 |
| Methane Sulfonic Acid (70%) | 0 | 5 | 8 | 8 | 0 | 5 |
| Capric/Caprylic Acid (40/60) | 3 | 3 | 1 | 0.75 | 3 | 3 |
| Propylene Glycol-Technical Grade | 3 | 0 | 0 | 0 | 3 | 0 |
| Glycolic Acid (Hydroxy Acetic Acid) | 0 | 0 | 3 | 3 | 0 | 0 |
| Product Homogeneity | — | — | — | — | Clear | Clear |
| pH: Neat | — | — | — | — | — | — |
| Sp. Gravity (23.6° C.), g/mL | — | — | — | — | — | — |

| Ingredients | Formulation Sequence 141 | 142 | 143 | 144 | 145 | 146 |
|---|---|---|---|---|---|---|
| Deinoized Water | 25.1 | 21.35 | 28.1 | 29.6 | 30.1 | 32.6 |
| Acetic Acid | 0.25 | 0.25 | 0.25 | 0.25 | 0.25 | 0.25 |
| Genamin TAP 100D | — | — | 0.15 | 0.15 | 0.15 | 0.15 |
| Genamin OLP | 0.15 | 0.15 | — | — | — | — |
| Plurafac LF-303 | 1 | 1 | 1 | 1 | 1 | 1 |
| Plurafac SLF-18B | — | — | 1.5 | 1.5 | 1.5 | 1.5 |
| Plurafac S-305LF | 1.5 | 1.5 | — | — | — | — |
| Plurafac LF-305 | — | — | — | — | — | — |
| Plurafac LF-18B45 | 0 | 0 | — | — | — | — |
| Anhydrous Citric Acid | 0 | 0 | 0 | 0 | 0 | 0 |
| Phosphoric Acid (75%) Food Grade | 30 | 36 | 30 | 26 | 22 | 18 |
| Sodium Xylene Sulfonate (40%) | 30 | 28 | 31 | 32 | 34 | 34 |
| Methane Sulfonic Acid (70%) | 8 | 8 | 5 | 6.5 | 8 | 9.5 |
| Capric/Caprylic Acid (40/60) | 1 | 0.75 | 3 | 3 | 3 | 3 |
| Propylene Glycol-Technical Grade | 0 | 0 | 0 | 0 | 0 | 0 |
| Glycolic Acid (Hydroxy Acetic Acid) | 3 | 3 | — | — | — | — |
| Product Homogeneity | Clear | Clear | Clear | Clear | Clear | Clear |
| pH: Neat | — | — | 0.45 | 0.31 | 0.32 | 0.18 |
| Sp. Gravity (23.6° C.), g/mL | — | — | 1.187 | 1.197 | 1.182 | 1.238 |

Antimicrobial Trials

As noted above, as all-in-one detergents, formulations according to the present invention preferably have antimicrobial functionality. In the food processing industry, especially in the dairy industry, it is important to sanitize food handling equipment so as to avoid build up of potentially harmful microbial species such as gram-positive and grain-negative bacteria (e.g., *Pseudomonas aeruginosa, Escherichia coli, Staphylococcus aureus*, and *Enterococcus hirae*) which could contaminate the milk product.

Antimicrobial organic acids are preferred sanitizing agents for use with the present invention. Exemplary antimicrobial organic acids include dodecylbenzenesulfonic acid, napthalenesulfonic acid, benzoic acid, and short chain fatty acids (such as octanoic acid, decanoic acid, nonanoic acid), sulfonated oleic acid, salicylic acid, and α-hydroxy acids (such as lactic acid and glycolic acid). The term "short chain fatty acids" as used herein refers to those acids generally having from about 4-15 carbon atoms, preferably from about 6-12 carbon atoms, and more preferably from about 8-10 carbon atoms. In various preferred embodiments, a blend of a C8-C9 fatty acid and a C10-C12 fatty acid is used. Additional exemplary short chain fatty acids include octanoic acid (caprylic acid, C8 alkyl radical), decanoic acid (capric acid, C10 alkyl radical), and blends thereof. A particularly preferred blend of caprylic and capric acids is a 58/40 blend, respectively, that also includes small amounts of hexanoic acid by Cognis Oleochemicals produced under the name EMERY 658.

Traditional antibacterial agents like chlorophenols, (e.g., p-choro-m-xylenol (PCMX) and 2,4,4-Trichloro-2-hydoxydiphenyl ether (Trichlosan)) and chlorohexidine can be used with the present invention. Preferred germicidal agents for use with the inventive detergents also include nontoxic biodegradable monohydric alcohols, selected polyhydric alcohols, aromatic and aliphatic alcohols. Preferred monohydric alcohols are selected from the group consisting of isopropyl, methyl, ethyl, propyl, isopropyl, n-butyl, isobutyl, tert-butyl, benzyl, and allyl alcohols and mixtures thereof. Preferred polyhydric alcohols are selected from the group consisting of propylene glycol, 1,3-propanediol, 1,2-butanediol, polyethylene glycol 400, glycerol, and 1,4-butanediol and mixtures thereof.

Non-chlorine bleaches, such as oxygen bleaching agents, can be used as antimicrobial agents. Preferred oxygen bleaching agents include organic and inorganic peroxygen bleaches and peracids, such as hydrogen peroxide, activated hydrogen peroxides like peracetic acid, activated sodium perborate with teraacetyl ethylenediamine (TAED) activator, alkali metal persulfates, and alkali metal percarbonates. The term "peroxygen compound" as used herein refers to any compound having a chemical formula including a —O—O— structure. Preferred peroxyacids for use with the present invention have the general structure: R—COOOH wherein R is a C1-C18 substituted or unsubstituted, saturated or unsaturated, linear, branched, or cyclic aliphatic, alkyl, or aromatic moiety. R substituent groups can include —OH, —COOH, or heteroatom (—O—, —S—, etc.) moieties, so long as the antimicrobial properties of the compositions are not significantly affected. Particularly preferred peroxyacid compounds are selected from the group consisting of peroxyfatty acids, monoperoxy or diperoxydicarboxylic acids, peroxyaromatic acids, peracetic acid, and perbenzoic acid. Generally, these types of sanitizing agents have the greatest antibacterial functionality at higher wash temperatures.

Bronopol (2-bromo-2-nitro-1,3-propanediol), the structure of which is shown below, is a water soluble broad spectrum antimicrobial preservative that is especially effective against *Pseudomonas aeruginosa*.

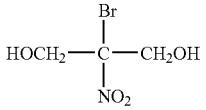

Bronopol is a formaldehyde-releasing agent that decomposes to formaldehyde and bromine compounds in neutral and alkaline pH conditions.

Other preferred antimicrobial compounds include several biguanide products, especially poly(hexamethylene biguanide) hydrochloride (PHNB), chlorohexidine diacetate (CHA) and chlorohexidine digluconate (CHG). These compounds are highly effective broad spectrum bactericides and are available from Avecia under the name VENTOCIL. The general chemical structures for PHMB and CHG follow.

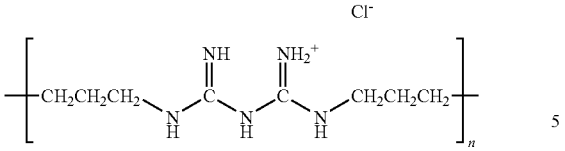

wherein $n_{avg}$=12 poly(hexamethylene biguanide) hydrochloride (PHMB)

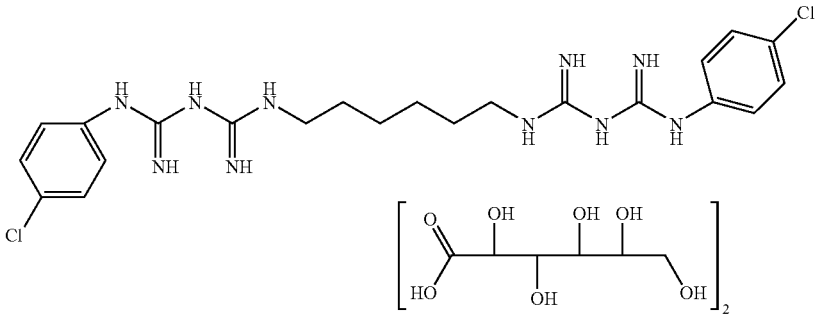

Chlorhexidine digluconate (CHG)

Particularly preferred biguanide formulations for use as antibacterial agents in accordance with the present invention include cationic formulations comprising about 20% by weight PHMB having a pH of about 4.0-5.0, and formulations comprising about 20% by weight CHG having a pH of about 5.5-7.0.

Inorganic salts such as sodium chloride (NaCl), sodium bicarbonate ($NaHCO_3$), sodium nitrate ($NaNO_3$), sodium nitrite ($NaNO_2$), sodium bisulfite ($NaHSO_3$), sodium sulfite ($Na_2SO_3$), sodium bisulfate ($NaHSO_4$) can be used as antimicrobial agents individually or in combination with other antimicrobial agents.

Chelating agents can be added to the compositions to enhance germicidal activity and cleaning performance. Exemplary chelating agents include ethylenediaminetetraacetic acid (EDTA), sodium ethylenediamineteraacetate salt ($Na_4$-EDTA), phosphonic acid, octyl phosphoric acid, acrylic acid, polyacrylic acid, aspartic acid, salicylic acid, succinic acid, tartaric acid, ascorbic acid, benzoic acid, sodium benzoate, p-hydroxy benzoic acids and the corresponding esters derivatives (parabans).

Antibacterial efficacy can be further enhanced using traditional preservatives such as glutaraldehyde (Ucarcide) and quaternary ammonium compounds.

The inventive detergent compositions described herein preferably comprise up to about 20% by weight antimicrobial agent, more preferably from about 0.5-10% by weight, even more preferably from about 1-8% by weight, and most preferably from about 1.5-6% by weight.

Table 11 illustrates two compositions in accordance with the present invention, one comprising an antimicrobial agent (mixture of capric/caprylic acid and propylene glycol) and one without, and compares the milk soil cleaning efficacy of each at various wash temperatures and concentrations. Both compositions provided excellent cleaning at the higher temperatures washes.

TABLE 11

Comparison Between Fatty Alkyl Diaminopropane Detergents With and Without Sanitizing Agent

| | Formulation Sequence | |
|---|---|---|
| Ingredients | 147 | 148 |
| Deionized Water | 21.85 | 66.6 |
| Acetic Acid | 1 | 0.25 |
| Genamin OLP 100 | 0.15 | 0.15 |
| Plurafac LF-303 | 1.5 | 1 |
| Plurafac SLF-18B | 1.5 | 2 |
| Anhydrous Citric Acid | 3 | — |
| Phosphoric Acid (75%) Food Grade | 35 | 15 |
| Sodium Xylene Sulfonate (40%) | 30 | — |
| Methane Sulfonic Acid (70%) | — | 15 |

TABLE 11-continued

| Comparison Between Fatty Alkyl Diaminopropane Detergents With and Without Sanitizing Agent | | |
|---|---|---|
| Capric/Caprylic Acid (40/60) | 3 | — |
| Propylene Glycol | 3 | — |

| | | Cleaning Performance/400 ppm Hard Water Milk Soil Cleaning, %; Film Deposit: Higher Number = Better Cleaning | | | | | | | |
|---|---|---|---|---|---|---|---|---|---|
| | % V/V | 25° C./8 min | | 30° C./8 min | | 40° C./8 min | | 60° C./8 min | |
| Products Compared | Concentration | Cleaning | Filming | Cleaning | Filming | Cleaning | Filming | Cleaning | Filming |
| 147 | 0.40% | 38 | 1 | 44 | 1 | 77 | 1.5 | 98 | 3.5 |
| 148 | 0.50% | 70 | 1.5 | 75 | 2 | 90 | 2.5 | 97 | 4 |
| | 0.40% | 67 | 1 | 69 | 1.5 | 88 | 2.5 | 96 | 4 |
| | 0.30% | 59 | 1 | 71 | 2 | 86 | 2.5 | 90 | 2.5 |
| | 0.25% | 53 | 1 | 64 | 2 | 86 | 2 | 92 | 2.5 |

Germicidal Efficacy Tests

In the following examples, the germicidal efficacy of several detergent formulations made in accordance with the present invention were determined by Basic Bactericidal Activity-European Standard EN 1040 and Bactericidal Activity of Chemical Disinfectants and Antiseptics used in Food, Industrial, Domestic, and Industrial Areas-European Standard EN 1276.

European Standard EN 1040 sets forth a suspension test method for establishing whether a chemical disinfectant or antiseptic meets certain minimum antimicrobial criteria when used at a recommended concentration. This standard is primarily directed toward agricultural products. If a product meets the minimum test requirements, for regulatory purposes, it is considered as possessing bactericidal functionality. The product must demonstrate a $10^5$ reduction (5 log reduction i.e., 99.999% reduction) in vial counts for *Pseudomonas aeruginosa* (ATCC 15442) and *Staphylococcus aureus* (ATCC 6538).

In this test, a suspension of bacteria was added to a prepared sample of the detergent formulation being tested. The mixture was maintained at 20° C. After a specified contact time (5 minutes), an aliquot was taken and the bactericidal action in this portion was immediately neutralized or suppressed by a validation method. (i.e., by a dilution-neutralization method). The neutralizing composition used comprised: 3 g lecithin, 30 g polysorbate 80, 5 g sodium thiosulphate, 1 g L-histidine chlorhydrate, 30 g saponine, QS of distilled water to 500 mL, 10 mL of 0.25 M phosphate buffer, and QS of distilled water to 1000 mL.

Tables 12-21 show the EN 1040 test results for many different compositions made in accordance with the invention. It is important to note that the EN 1040 test is performed at 20° C., whereas in practice, the detergent compositions will be used at higher temperatures (preferably about 60° C.). Therefore, even though a detergent formulation does not pass the EN 1040 test, it may still produce a 5 log reduction in microbes when used at the higher temperature.

TABLE 12

| Detergent Cleaning Performance and Germicidal Data | | | | |
|---|---|---|---|---|
| | Formulation Sequence | | | |
| Ingredients | 151 | 152 | 153 | 154 |
| Deionized Water | 37.85 | 36.85 | 36.85 | 36.85 |
| Acetic Acid | 1 | 1 | 1 | 1 |
| Duomeen SV | 0.15 | 0.15 | 0.15 | 0.15 |
| Plurafac LF-303 | 1.5 | 1.5 | 1.5 | 1.5 |
| Plurafac S305-LF | 1.5 | 1.5 | 1.5 | 1.5 |
| Anhydrous Citric Acid | 3 | 3 | 3 | 3 |
| Phosphoric Acid (75%) | 55 | 55 | 55 | 55 |
| Nitric Acid (70%) | — | — | — | — |
| NaHSO4 | — | — | — | — |
| Ventocil P (20%) | — | — | — | — |
| Lactic Acid | — | 1 | — | — |
| Glycolic Acid | — | — | 1 | — |
| Polyaspartic Acid Sodium Salt (40%) | — | — | — | 1 |
| Bronopol | — | — | — | — |
| Product Homogeneity | Clear Phase | Clear Phase | Clear Phase | Clear Phase |
| pH: Neat (° C.) | 0.91(27.1) | 0.95(27.6) | 0.97(26.6) | 0.93(27.5) |
| Sp. Gravity, g/mL | 1.307 | 1.31 | 1.312 | 1.312 |
| | Cleaning Performance | | | |
| Usage Concentration, g/L | 5 g/L | 5 g/L | 5 g/L | 5 g/L |
| Wash Temperature, ° C. | 60 | 61 | 61 | 61 |
| Milk Soil Cleaning/400 ppm HW, % | 96 | 98 | 97 | 97 |
| Powder Chloroalkaline Detergent Control @ 2 g/L, % | 95 | 95 | 95 | 95 |

TABLE 12-continued

| Detergent Cleaning Performance and Germicidal Data | | | | |
|---|---|---|---|---|
| Bacterial Activity EN 1040 Report | | | | |
| *Pseudomonas Aeruginosa* | Reduction | Reduction | Reduction | Reduction |
| Use Concentration-0.5% | $<0.6 \times 10^4$ | $<0.6 \times 10^4$ | $>1.3 \times 10^5$ | $>1.3 \times 10^5$ |
| Use Concentration-1.0% | $<0.8 \times 10^4$ | $<0.6 \times 10^4$ | $>1.3 \times 10^5$ | $>1.3 \times 10^5$ |
| Use Concentration-2.0% | $>1.1 \times 10^5$ | $>1.1 \times 10^5$ | $>1.3 \times 10^5$ | $>1.3 \times 10^5$ |
| *Staphylococcus Aureus* | Reduction | Reduction | Reduction | Reduction |
| Use Concentration-0.5% | $<0.9 \times 10^4$ | $<0.9 \times 10^4$ | $<0.8 \times 10^4$ | $<0.8 \times 10^4$ |
| Use Concentration-1.0% | $<0.9 \times 10^4$ | $<0.9 \times 10^4$ | $<0.8 \times 10^4$ | $<0.8 \times 10^4$ |
| Use Concentration-2.0% | $<0.9 \times 10^4$ | $<0.9 \times 10^4$ | $<0.8 \times 10^4$ | $<0.8 \times 10^4$ |
| Foaming Assmnt.-Dairy Pipe Line | Acceptable | Acceptable | Acceptable | Acceptable |

| | Formulation Sequence | | | |
|---|---|---|---|---|
| Ingredients | 155 | 156 | 157 | 158 |
| Deionized Water | 36.85 | 30.85 | 36.85 | 34.85 |
| Acetic Acid | 1 | 1 | 1 | 1 |
| Duomeen SV | 0.15 | 0.15 | 0.15 | 0.15 |
| Plurafac LF-303 | 1.5 | 1.5 | 1.5 | 1.5 |
| Plurafac S305-LF | 1.5 | 1.5 | 1.5 | 1.5 |
| Anhydrous Citric Acid | 3 | 3 | 3 | 3 |
| Phosphoric Acid (75%) | 55 | 55 | 55 | 55 |
| Nitric Acid (70%) | — | — | 1 | — |
| NaHSO4 | — | — | — | 3 |
| Ventocil P (20%) | — | 7 | — | — |
| Lactic Acid | — | — | — | — |
| Glycolic Acid | — | — | — | — |
| Polyaspartic Acid Sodium Salt (40%) | — | — | — | — |
| Bronopol | 1 | — | — | — |
| Product Homogeneity | Clear Phase | Clear Phase | Clear Phase | Clear Phase |
| pH: Neat (° C.) | 0.74 (23.7) | 0.76 (24.8) | 0.77 (24.5) | 0.74 (23.9) |
| Sp. Gravity, g/mL | 1.317 | 1.313 | 1.314 | 1.341 |
| Cleaning Performance | | | | |
| Usage Concentration, g/L | 5 g/L | 5 g/L | 5 g/L | 5 g/L |
| Wash Temperature, ° C. | 61 | 61 | 60 | 61 |
| Milk Soil Cleaning/400 ppm HW, % | 97 | 99 | 96 | 98 |
| Powder Chloroalkaline Detergent Control @ 2 g/L, % | 95 | 95 | 95 | 95 |
| Bacterial Activity EN 1040 Report | | | | |
| *Pseudomonas Aeruginosa* | Reduction | Reduction | Reduction | Reduction |
| Use Concentration-0.5% | $<0.8 \times 10^4$ | $>1.9 \times 10^5$ | $>1.9 \times 10^5$ | $<0.8 \times 10^4$ |
| Use Concentration-1.0% | $<0.8 \times 10^4$ | $>1.9 \times 10^5$ | $>1.9 \times 10^5$ | $>1.5 \times 10^5$ |
| Use Concentration-2.0% | $>1.5 \times 10^5$ | $>1.9 \times 10^5$ | $>1.9 \times 10^5$ | $>1.5 \times 10^5$ |
| *Staphylococcus Aureus* | Reduction | Reduction | Reduction | Reduction |
| Use Concentration-0.5% | $<0.8 \times 10^4$ | $<0.6 \times 10^4$ | $<0.6 \times 10^4$ | $<0.8 \times 10^4$ |
| Use Concentration-1.0% | $<0.8 \times 10^4$ | $<0.6 \times 10^4$ | $<0.6 \times 10^4$ | $<0.8 \times 10^4$ |
| Use Concentration-2.0% | $<0.8 \times 10^4$ | $<0.6 \times 10^4$ | $<0.6 \times 10^4$ | $<0.8 \times 10^4$ |
| Foaming Assmnt.-Dairy Pipe Line | Acceptable | Acceptable | Acceptable | Acceptable |

TABLE 13

| Detergent Cleaning Performance and Germicidal Data | | | |
|---|---|---|---|
| | Formulation Sequence | | |
| Ingredients | 159 | 160 | 161 |
| Deionized Water | 36.85(34.85) | 36.85(43.85) | 30.85(27.85) |
| Acetic Acid | 1 | 1 | 1 |
| Duomeen O | — | — | — |
| Duomeen SV | 0.15 | 0.15 | 0.15 |
| Plurafac SLF-18B | — | — | — |
| Plurafac LF-4030 (Defoamer) | — | — | — |
| Plurafac LF-303 | 1.5 | 1.5 | 1.5 |
| Plurafac S305-LF | 1.5 | 1.5 | 1.5 |
| Anhydrous Citric Acid | 3 | 3 | 3 |
| Phosphoric Acid (75%) | 55 | 55 | 55 |
| Sodium Octane Sulfonate (30%) | — | — | — |
| NaHSO4 | — | — | — |
| Ventocil P (20%) | — | — | 7.00(10.00) |
| Glycolic Acid | 1.00(3.00) | — | — |

TABLE 13-continued

| Detergent Cleaning Performance and Germicidal Data | | | |
|---|---|---|---|
| Nitric Acid (70%) | — | 1.00(3.00) | — |
| pH: Neat (° C.) | 0.97(0.82) | 0.93(0.95) | 0.76(0.82) |
| Sp. Gravity, g/mL | 1.310(1.321) | 1.312(1.318) | 1.313(1.315) |
| Cleaning Performance | | | |
| Usage Concentration, g/L | 5 g/L | 5 g/L | 5 g/L |
| Wash Temperature, ° C. | 60(61) | 60(61) | 60(61) |
| Milk Soil Cleaning/400 ppm HW, % | 99(96) | 97(97) | 99(97) |
| Powder Chloroalkaline Detergent Control @ 2 G/L, % | 98(95) | 98(95) | 98(95) |
| Bacterial Activity EN 1040 Report | | | |
| *Pseudomonas Aeruginosa* | Reduction | Reduction | Reduction |
| Use Concentration-0.5% | $<1.3(1.8) \times 10^5$ | $<1.3(1.3) \times 10^5$ | $<1.9(1.3) \times 10^5$ |
| Use Concentration-1.0% | $<1.3(1.8) \times 10^5$ | $<1.3(1.3) \times 10^5$ | $<1.9(1.3) \times 10^5$ |
| Use Concentration-2.0% | $<1.3(1.8) \times 10^5$ | $<1.3(1.3) \times 10^5$ | $<1.9(1.3) \times 10^5$ |
| *Staphylococcus Aureus* | Reduction | Reduction | Reduction |
| Use Concentration-0.5% | $<0.8(0.7) \times 10^4$ | $<0.8(0.7) \times 10^4$ | $<0.6(0.7) \times 10^4$ |
| Use Concentration-1.0% | $<0.8(0.7) \times 10^4$ | $<0.8(0.7) \times 10^4$ | $<0.6(0.7) \times 10^4$ |
| Use Concentration-2.0% | $<0.8(0.7) \times 10^4$ | $<0.8(0.7) \times 10^4$ | $<0.6(0.7) \times 10^4$ |
| Foaming Assmnt.-Dairy Pipe Line | Acceptable | Acceptable | Acceptable |

| | Formulation Sequence | | | |
|---|---|---|---|---|
| Ingredients | 162 | 163 | 164 | 165 |
| Deionized Water | 36.85(35.85) | 38 | 27 | 48.5 |
| Acetic Acid | 1 | — | — | 1.5 |
| Duomeen O | — | — | — | 3 |
| Duomeen SV | 0.15 | — | — | — |
| Plurafac SLF-18B | — | 2 | 2 | — |
| Plurafac LF-4030 (Defoamer) | — | — | — | 3 |
| Plurafac LF-303 | 1.5 | — | — | — |
| Plurafac S305-LF | 1.5 | — | — | — |
| Anhydrous Citric Acid | 3 | 3 | 3 | 3 |
| Phosphoric Acid (75%) | 55 | 43 | 43 | 43 |
| Sodium Octane Sulfonate (30%) | — | 9 | 21 | — |
| NaHSO4 | — | 5 | 2 | — |
| Ventocil P (20%) | — | — | 2 | — |
| Glycolic Acid | — | — | — | — |
| Nitric Acid (70%) | 1.00(200) | — | — | — |
| pH: Neat (° C.) | 0.77(0.78) | — | — | — |
| Sp. Gravity, g/mL | 1.312(1.318) | — | — | — |
| Cleaning Performance | | | | |
| Usage Concentration, g/L | 5 g/L | 5 g/L | 5 g/L | 5 g/L |
| Wash Temperature, ° C. | 60(61) | 61 | 61 | 61 |
| Milk Soil Cleaning/400 ppm HW, % | 96(96) | 99 | 98 | 100 |
| Powder Chloroalkaline Detergent Control @ 2 G/L, % | 98(95) | 98 | 98 | 98 |
| Bacterial Activity EN 1040 Report | | | | |
| *Pseudomonas Aeruginosa* | Reduction | Reduction | Reduction | Reduction |
| Use Concentration-0.5% | $<1.9(1.8) \times 10^5$ | $>1.5 \times 10^5$ | $>1.5 \times 10^5$ | $>1.3 \times 10^5$ |
| Use Concentration-1.0% | $<1.9(1.8) \times 10^5$ | $>1.5 \times 10^5$ | $>1.5 \times 10^5$ | $>1.3 \times 10^5$ |
| Use Concentration-2.0% | $<1.9(1.8) \times 10^5$ | $>1.5 \times 10^5$ | $>1.5 \times 10^5$ | $>1.3 \times 10^5$ |
| *Staphylococcus Aureus* | Reduction | Reduction | Reduction | Reduction |
| Use Concentration-0.5% | $<0.6(0.7) \times 10^4$ | $<0.5 \times 10^5$ | $<0.6 \times 10^4$ | $<0.6 \times 10^4$ |
| Use Concentration-1.0% | $<0.6(0.7) \times 10^4$ | $>1.2 \times 10^5$ | $0.3 \times 10^5$ | $1.2 \times 10^4$ |
| Use Concentration-2.0% | $<0.6(0.7) \times 10^4$ | $>1.2 \times 10^5$ | $>1.2 \times 10^5$ | $>1.2 \times 10^5$ |
| Foaming Assmnt.-Dairy Pipe Line | Acceptable | — | — | Acceptable |

TABLE 14

| Detergent Cleaning Performance and Germicidal Data | | | | | | | |
|---|---|---|---|---|---|---|---|
| | Formula | | | | | | |
| Ingredients | 166 | 167 | 168 | 169 | 170 | 171 | 172 |
| Deionized Water | 38 | 20 | 18.85 | 38.35 | 38.35 | 18.85 | 19.85 |
| Acetic Acid | — | — | 1 | 1 | 1 | 1 | 1 |
| Duomeen O | — | — | — | — | — | — | — |
| Duomeen SV | — | — | 0.15 | 0.15 | 0.15 | 0.15 | 0.15 |

TABLE 14-continued

| Detergent Cleaning Performance and Germicidal Data | | | | | | | |
|---|---|---|---|---|---|---|---|
| Plurafac SLF-18B | 2 | 3 | — | — | 3 | 3 | 2 |
| Plurafac LF-303 | — | — | 1.5 | 1.5 | — | — | — |
| Plurafac S305-LF | — | — | 1.5 | 1.5 | — | — | — |
| Anhydrous Citric Acid | 3 | 3 | 3 | 3 | 3 | 3 | 3 |
| Phosphoric Acid (75%) | 43 | 43 | 43 | 43 | 43 | 43 | 43 |
| Sodium Octane Sulfonate (30%) | 9 | — | — | — | — | — | — |
| Sodium Xylene Sulfonate (40%) | — | 26 | 26 | — | — | 26 | 26 |
| Sulfuric Acid (98%) | — | — | — | 1 | 10 | — | — |
| NaHSO4 | 5 | 5 | 5 | — | — | 5 | 5 |
| Ventocil P (20%) | — | — | — | — | — | — | — |
| Glycolic Acid | — | — | — | 1.5 | 1.5 | — | — |
| Nitric Acid (70%) | — | — | — | — | — | — | — |
| Product Homogeneity | Clear | Clear/Haze | Clear | Clear | Haze | Haze/Top Sep | Clear |
| pH: Neat (° C.) | — | 0.83 | 0.82 | 0.63 | 0.69 | 0.66 | 0.61 |
| Sp. Gravity, g/mL | 1.28 | 1.3322 | 1.3479 | 1.3277 | 1.3271 | 1.3464 | 1.3464 |
| Cleaning Performance | | | | | | | |
| Usage Concentration, g/L | 5 g/L | 5 g/L | 5 g/L | 5 g/L | 5 g/L | 5 g/L | 5 g/L |
| Wash Temperature, ° C. | 61 | 60 | 60 | 60 | 60 | 60 | 60 |
| Milk Soil Cleaning/400 ppm HW, % | 99 | 93(99) | 93(98) | 94(96) | 97 | 99 | 96 |
| Powder Chloroalkaline Detergent Control @ 2 g/L, % | 98 | 98 | 98 | 98 | 98 | 98 | 98 |
| Bacterial Activity EN 1040 Report | | | | | | | |
| *Pseudomonas Aeruginosa* | | | | Reduction | | | |
| Use Concentration 0.5% | $>1.5 \times 10^5$ | $>1.3 \times 10^5$ | $>1.3 \times 10^5$ | $>1.3 \times 10^5$ | $>1.3 \times 10^5$ | $>1.3 \times 10^5$ | $>1.3 \times 10^5$ |
| Use Concentration 1.0% | $>1.5 \times 10^5$ | $>1.3 \times 10^5$ | $>1.3 \times 10^5$ | $>1.3 \times 10^5$ | $>1.3 \times 10^5$ | $>1.3 \times 10^5$ | $>1.3 \times 10^5$ |
| Use Concentration 2.0% | $>1.5 \times 10^5$ | $>1.3 \times 10^5$ | $>1.3 \times 10^5$ | $>1.3 \times 10^5$ | $>1.3 \times 10^5$ | $>1.3 \times 10^5$ | $>1.3 \times 10^5$ |
| *Staphylococcus Aureus* | | | | Reduction | | | |
| Use Concentration 0.5% | $<0.5 \times 10^5$ | $0.11 \times 10^5$ | $<0.06 \times 10^5$ | $<0.06 \times 10^5$ | $<0.07 \times 10^5$ | $<0.06 \times 10^5$ | $<0.06 \times 10^5$ |
| Use Concentration 1.0% | $>1.2 \times 10^5$ | $>1.2 \times 10^5$ | $>1.2 \times 10^5$ | $0.21 \times 10^5$ | $0.24 \times 10^5$ | $>1.2 \times 10^5$ | $0.3 \times 10^5$ |
| Use Concentration 2.0% | $>1.2 \times 10^5$ | $>1.2 \times 10^5$ | $>1.0 \times 10^5$ | $>1.3 \times 10^5$ | $>1.3 \times 10^5$ | $>1.2 \times 10^5$ | $0.2 \times 10^5$ |
| Foaming Assmnt. | Unacceptable | Acceptable | Acceptable | Acceptable | Acceptable | Acceptable | Acceptable |

| | Formula | | | | |
|---|---|---|---|---|---|
| Ingredients | 173 | 174 | 175 | 176 | 177 |
| Deionized Water | 33.35 | 38.35 | 36.85(35.85) | 36.85(35.85) | 27 |
| Acetic Acid | 1 | 1 | 1 | 1 | — |
| Duomeen O | — | — | — | — | — |
| Duomeen SV | 0.15 | 0.15 | 0.15 | 0.15 | — |
| Plurafac SLF-18B | 3 | 2 | — | — | 2 |
| Plurafac LF-303 | — | — | 1.5 | 1.5 | — |
| Plurafac S305-LF | — | — | 1.5 | 1.5 | — |
| Anhydrous Citric Acid | 3 | 3 | 3 | 3 | 3 |
| Phosphoric Acid (75%) | 43 | 43 | 55 | 55 | 43 |
| Sodium Octane Sulfonate (30%) | — | — | — | — | 21 |
| Sodium Xylene Sulfonate (40%) | — | — | — | — | — |
| Sulfuric Acid (98%) | 15 | 10 | — | — | — |
| NaHSO4 | — | — | — | — | 2 |
| Ventocil P (20%) | — | — | — | — | 2 |
| Glycolic Acid | 1.5 | 1.5 | — | — | — |
| Nitric Acid (70%) | — | — | 1.00(2.00) | 1.00(2.00) | — |

TABLE 14-continued

Detergent Cleaning Performance and Germicidal Data

| Product | Haze | Haze/Top Sep | Clear | Clear | Clear |
|---|---|---|---|---|---|
| Homogeneity | | | | | |
| pH: Neat (° C.) | 0.61 | 0.54 | 0.77(0.78) | 0.77(0.78) | — |
| Sp. Gravity, g/mL | 1.3708 | 1.3263 | 1.312(1.318) | 1.312(1.318) | 1.26 |
| | | Cleaning Performance | | | |
| Usage Concentration, g/L | 5 g/L | 5 g/L | 5 g/L | 5 g/L | 5 g/L |
| Wash Temperature, ° C. | 60 | 60 | 60(61) | 60(61) | 61 |
| Milk Soil Cleaning/400 ppm HW, % | 97 | 97 | 96(96) | 96(96) | 98 |
| Powder Chloroalkaline Detergent Control @ 2 g/L, % | 98 | 98 | 98(95) | 98(95) | 98 |
| | | Bacterial Activity EN 1040 Report | | | |
| *Pseudomonas Aeruginosa* | | | Reduction | | |
| Use Concentration 0.5% | $>1.3 \times 10^5$ | $>1.3 \times 10^5$ | $>1.9(1.8) \times 10^5$ | $>1.9(1.8) \times 10^5$ | $>1.5 \times 10^5$ |
| Use Concentration 1.0% | $>1.3 \times 10^5$ | $>1.3 \times 10^5$ | $>1.9(1.8) \times 10^5$ | $>1.9(1.8) \times 10^5$ | $>1.5 \times 10^5$ |
| Use Concentration 2.0% | $>1.3 \times 10^5$ | $>1.3 \times 10^5$ | $>1.9(1.8) \times 10^5$ | $>1.9(1.8) \times 10^5$ | $>1.5 \times 10^5$ |
| *Staphylococcus* Aureus | | | Reduction | | |
| Use Concentration 0.5% | $<0.07 \times 10^5$ | $<0.07 \times 10^5$ | $<0.06(0.7) \times 10^4$ | $>1.3(>1.3) \times 10^5$ | $<0.06 \times 10^5$ |
| Use Concentration 1.0% | $0.3 \times 10^5$ | $0.30 \times 10^5$ | $<0.06(0.7) \times 10^4$ | $>1.3(>1.3) \times 10^5$ | $0.30 \times 10^5$ |
| Use Concentration 2.0% | $1.1 \times 10^5$ | $>1.3 \times 10^5$ | $<0.06(0.7) \times 10^4$ | $>1.3(>1.3) \times 10^5$ | $>1.2 \times 10^5$ |
| Foaming Assmnt. | Acceptable | Acceptable | Acceptable | Acceptable | Unacceptable |

TABLE 15

Detergent Cleaning Performance and Germicidal Data

| | Formula | | | | | |
|---|---|---|---|---|---|---|
| Ingredients | 178 | 179 | 180 | 181 | 182 | 183 |
| Deionized Water | 45 | 44 | 42.5 | 46 | 43 | 48.5 |
| Acetic Acid | 1 | 1 | 1.5 | — | 1 | 1.5 |
| Duomac T (Diacetates) | — | — | — | 3 | 3 | — |
| Plurafac SLF-18B | — | — | — | — | — | — |
| Plurafac LF-4030 (Defoamer) | 2 | 3 | 3 | 3 | 3 | 3 |
| Anhydrous Citric Acid | 3 | 3 | 3 | 3 | 3 | 3 |
| Phosphoric Acid (75%) | 43 | 43 | 43 | 43 | 43 | 43 |
| Sodium Octane Sulfonate (30%) | — | — | — | — | — | — |
| NaHSO4 | 2 | 2 | 2 | | 2 | — |
| Ventocil P (20%) | 2 | 2 | 2 | 2 | 2 | — |
| | | Cleaning Performance | | | | |
| Usage Concentration, g/L | 5 g/L | 5 g/L | 5 g/L | 5 g/L | 5 g/L | 5 g/L |
| Wash Temperature, ° C. | 61 | 61 | 61 | 61 | 61 | 61 |
| Milk Soil Cleaning/400 ppm HW, % | 100 | 99 | 100 | 100 | 100 | 100 |
| Powder Chloroalkaline Detergent Control @ 2 g/L, % | 98 | 98 | 98 | 98 | 98 | 98 |
| | | Bacterial Activity EN 1040 Report | | | | |
| *Pseudomonas Aeruginosa* | Reduction | Reduction | Reduction | Reduction | Reduction | Reduction |
| Use Concentration 0.5% | $>1.3 \times 10^5$ | $>1.3 \times 10^5$ | $>1.3 \times 10^5$ | $>1.3 \times 10^5$ | $>1.3 \times 10^5$ | $>1.3 \times 10^5$ |
| Use Concentration 1.0% | $>1.3 \times 10^5$ | $>1.3 \times 10^5$ | $>1.3 \times 10^5$ | $>1.3 \times 10^5$ | $>1.3 \times 10^5$ | $>1.3 \times 10^5$ |
| Use Concentration 2.0% | $>1.3 \times 10^5$ | $>1.3 \times 10^5$ | $>1.3 \times 10^5$ | $>1.3 \times 10^5$ | $>1.3 \times 10^5$ | $>1.3 \times 10^5$ |
| *Staphylococcus Aureus* | Reduction | Reduction | Reduction | Reduction | Reduction | Reduction |

TABLE 15-continued

| Detergent Cleaning Performance and Germicidal Data | | | | | | |
|---|---|---|---|---|---|---|
| Use Concentration 0.5% | $<0.8 \times 10^4$ | $<0.7 \times 10^4$ | $<0.7 \times 10^4$ | $<0.7 \times 10^4$ | $<0.6 \times 10^4$ | $<0.6 \times 10^4$ |
| Use Concentration 1.0% | $<0.8 \times 10^4$ | $<0.7 \times 10^4$ | $<0.7 \times 10^4$ | $<0.7 \times 10^4$ | $<0.6 \times 10^4$ | $1.2 \times 10^4$ |
| Use Concentration 2.0% | $<0.8 \times 10^4$ | $<0.7 \times 10^4$ | $<0.7 \times 10^4$ | $<0.7 \times 10^4$ | $<0.6 \times 10^4$ | $>1.2 \times 10^5$ |
| Foaming Assmnt.-Dairy Pipe Line | Not Acceptable | Not Acceptable | — | — | — | — |

| | Formula | | | | |
|---|---|---|---|---|---|
| Ingredients | 184 | 185 | 186 | 187 | 188 |
| Deionized Water | 50 | 38 | 45 | 48 | 47 |
| Acetic Acid | — | — | 1 | — | 1 |
| Duomac T (Diacetates) | 2 | — | — | 2 | — |
| Plurafac SLF-18B | — | 2 | 2 | 2 | — |
| Plurafac LF-4030 (Defoamer) | — | — | — | — | — |
| Anhydrous Citric Acid | 3 | 3 | 3 | 3 | 3 |
| Phosphoric Acid (75%) | 43 | 43 | 43 | 43 | 43 |
| Sodium Octane Sulfonate (30%) | — | 9 | — | — | — |
| NaHSO4 | — | 5 | 2 | 2 | 2 |
| Ventocil P (20%) | 2 | — | 2 | 2 | 2 |
| Cleaning Performance | | | | | |
| Usage Concentration, g/L | 5 g/L | 5 g/L | 5 g/L | | 5 g/L |
| Wash Temperature, ° C. | 61 | 61 | 61 | 61 | 60 |
| Milk Soil Cleaning/400 ppm HW, % | 100 | 99 | 99 | 99 | 100 |
| Powder Chloroalkaline Detergent Control @ 2 g/L, % | 98 | 98 | 98 | 98 | 98 |
| Bacterial Activity EN 1040 Report | | | | | |
| *Pseudomonas Aeruginosa* | Reduction | Reduction | Reduction | Reduction | Reduction |
| Use Concentration 0.5% | $>1.0 \times 10^5$ | $>1.5 \times 10^5$ | $>1.5 \times 10^5$ | $>1.3 \times 10^5$ | $>1.3 \times 10^5$ |
| Use Concentration 1.0% | $>1.0 \times 10^5$ | $>1.5 \times 10^5$ | $>1.5 \times 10^5$ | $>1.3 \times 10^5$ | $>1.3 \times 10^5$ |
| Use Concentration 2.0% | $>1.0 \times 10^5$ | $>1.5 \times 10^5$ | $>1.5 \times 10^5$ | $>1.3 \times 10^5$ | $>1.3 \times 10^5$ |
| *Staphylococcus Aureus* | Reduction | Reduction | Reduction | Reduction | Reduction |
| Use Concentration 0.5% | $<0.9 \times 10^4$ | $<0.5 \times 10^5$ | $<0.6 \times 10^4$ | $>1.3 \times 10^4$ | $>1.3 \times 10^4$ |
| Use Concentration 1.0% | $<0.9 \times 10^4$ | $>1.2 \times 10^5$ | $<0.6 \times 10^4$ | $>1.3 \times 10^4$ | $>1.3 \times 10^4$ |
| Use Concentration 2.0% | $<0.9 \times 10^4$ | $>1.2 \times 10^5$ | $<0.6 \times 10^4$ | $>1.3 \times 10^4$ | $>1.3 \times 10^4$ |
| Foaming Assmnt.-Dairy Pipe Line | — | Not Acceptable | — | Not Acceptable | Not Acceptable |

TABLE 16

| Detergent Cleaning Performance and Germicidal Data | | | | | | |
|---|---|---|---|---|---|---|
| | Formulation | | | | | |
| Ingredients | 189 | 190 | 191 | 192 | 193 | 194 |
| Deionized Water | 41.85 | 51.85 | 42.85 | 23.85 | 23.85 | |
| Acetic Acid | 1 | 1 | 1 | 1 | 1 | 1 |
| Duomeen SV | 0.15 | 0.15 | 0.15 | 0.15 | 0.15 | 0.15 |
| Plurafac SLF-18B | 1.5 | 1.5 | 1.5 | 2 | 2 | 2 |
| Plurafac LF-303 | 1.5 | 1.5 | 1.5 | 1 | 1 | 1 |
| Anhydrous Citric Acid | 3 | 3 | 3 | 3 | 3 | 3 |
| Phosphoric Acid (75%) | 35 | 35 | 35 | 35 | 35 | 35 |
| Propylene Glycol | 3 | 3 | 3 | 3 | 3 | 3 |
| Sodium Xylene Sulfonate (40%) | — | — | — | 26 | 26 | 26 |
| $NaHSO_4$ | 10 | — | 10 | 5 | 5 | — |
| Triameen Y12D | 3 | 3 | 2 | — | — | — |
| Product Homogeneity | Clear | Clear | Clear | Clear | Clear | Clear |
| Wash Temperature, ° C./Minutes | 40/8 | 40/8 | 40/8 | 40/8 | 40/8 | 40/8 |
| Milk Soil Cleaning/400 ppm HW, % (film) | 85/82(+4/3) | 94(+5) | 83(+3) | 82(+1)/71(+2)/81(+1) | 88(+3)/82(+3) | 92(+5) |
| Powder Chloroalkaline Detergent Control @ 2 g/L, % (Av 3) | 62/61(std/std) | 62/61(std/std) | 62/61(std/std) | 62/61(std/std) | 62/61(std/std) | 62/61(std/std) |

TABLE 16-continued

Detergent Cleaning Performance and Germicidal Data

| Ingredients | Formulation 189 | 190 | 191 | 192 | 193 | 194 |
|---|---|---|---|---|---|---|
| *Pseudomonas Aeruginosa* | Reduction | Reduction | Reduction | Reduction | Reduction | Reduction |
| Use Concentration-0.5% | $>1.6 \times 10^5$ | $>1.6 \times 10^5$ | $>1.6 \times 10^5$ | $>1.2 \times 10^5$ | $>1.5 \times 10^5$ | $>1.5 \times 10^5$ |
| Use Concentratian-1.0% | $>1.6 \times 10^5$ | $>1.6 \times 10^5$ | $>1.6 \times 10^5$ | $>1.2 \times 10^5$ | $>1.5 \times 10^5$ | $>1.5 \times 10^5$ |
| Use Concentration-2.0% | $>1.6 \times 10^5$ | $>1.6 \times 10^5$ | $>1.6 \times 10^5$ | $>1.2 \times 10^5$ | $>1.5 \times 10^5$ | $>1.5 \times 10^5$ |
| *Staphylococcus Aureus* | Reduction | Reduction | Reduction | Reduction | Reduction | Reduction |
| Use Concentration-0.5% | $<0.8 \times 10^4$ | $<0.7 \times 10^4$ | $<0.8 \times 10^4$ | $<0.7 \times 10^4$ | $<0.57 \times 10^4$ | $<0.57 \times 10^4$ |
| Use Concentration-1.0% | $<0.8 \times 10^4$ | $<0.7 \times 10^4$ | $<0.8 \times 10^4$ | $<0.7 \times 10^4$ | $0.71 \times 10^5$ | $<0.57 \times 10^4$ |
| Use Concentration-2.0% | $<0.8 \times 10^4$ | $<0.7 \times 10^4$ | $<0.8 \times 10^4$ | $0.7 \times 10^5$ | $1.1 \times 10^5$ | $>1.1 \times 10^5$ |
| Foaming Assmnt.-Dairy Pipe Line | Acceptable | Acceptable | Acceptable | Acceptable | Acceptable | Acceptable |

TABLE 17

Detergent Cleaning Performance and Germicidal Data Continued

| Ingredients | Formulation Sequence 195 | 196 | 197 | 198 | 199 | 200 | 201 |
|---|---|---|---|---|---|---|---|
| Deionized Water | 26.85 | 20.85 | 15.85 | 18.85 | 24.85 | 23.85 | 31.85 |
| Acetic Acid | 1 | 1 | 1 | 1 | 1 | 1 | 1 |
| Duomeen SV | 0.15 | 0.15 | 0.15 | 0.15 | 0.15 | 0.15 | 0.15 |
| Plurafac SLF-18B | 2 | 2 | 2 | 2 | 2 | 2 | 2 |
| Plurafac LF-303 | 1 | 1 | 1 | 1 | 1 | 1 | 1 |
| Anhydrous Citric Acid | — | 3 | 3 | 3 | 3 | 3 | 3 |
| Phosphoric Acid (75%) | 35 | 43 | 43 | 43 | 35 | 35 | 20 |
| Propylene Glycol | 3 | 3 | 3 | 3 | 3 | 3 | 3 |
| Sodium Xylene Sulfonate (40%) | 26 | 26 | 26 | 26 | 28 | 28 | 30 |
| $NaHSO_4$ | 5 | — | 5 | 5 | — | — | — |
| Sulfamic Acid | — | — | 5 | — | — | — | 5 |
| Capric/Caprylic Acid (40/60) | — | — | — | — | 2 | 3 | 3 |
| Product Homogeneity | Clear | Clear | Clear | Clear | Clear | Clear | Clear |
| Wash Temperature, ° C./Minutes | 40/8 | 40/8 | 40/8 | 40/8 | 40/8 | 40/8 | 40/8 |
| Milk Soil Cleaning/400 ppm HW, % (film) | 68(+4)/82(+2) | 87(+5)/96(+4) | 75(+2) | 81(+2) | 68(+4)/82(+2) | 87(+5)/96(+4) | 75(+2) |
| Powder Chloroalkaline Detergent Control @ 2 gm/L, % (Av 3) | 62/61(std/std) | 62/61(std/std) | 62/61(std/std) | 62/61(std/std) | 62/61(std/std) | 62/61(std/std) | 62/61(std/std) |
| *Pseudomonas Aeruginosa* | Reduction | Reduction | Reduction | Reduction | Reduction | Reduction | Reduction |
| Use Concentration-0.5% | $>1.2 \times 10^5$ | $>1.5 \times 10^5$ | $>1.5 \times 10^5$ | $>1.2 \times 10^5$ | $>1.5 \times 10^5$ | $>1.5 \times 10^5$ | $>1.3 \times 10^5$ |
| Use Concentration-1.0% | $>1.2 \times 10^5$ | $>1.5 \times 10^5$ | $>1.5 \times 10^5$ | $>1.2 \times 10^5$ | $>1.5 \times 10^5$ | $>1.5 \times 10^5$ | $>1.3 \times 10^5$ |
| Use Concentration-2.0% | $>1.2 \times 10^5$ | $>1.5 \times 10^5$ | $>1.5 \times 10^5$ | $>1.2 \times 10^5$ | $>1.5 \times 10^5$ | $>1.5 \times 10^5$ | $>1.3 \times 10^5$ |
| *Staphylococcus Aureus* | Reduction | Reduction | Reduction | Reduction | Reduction | Reduction | Reduction |
| Use Concentration-0.5% | $<0.7 \times 10^4$ | $<0.57 \times 10^4$ | $<0.57 \times 10^4$ | $<0.7 \times 10^4$ | $0.64 \times 10^5$ | $>1.9 \times 10^5$ | $>1.9 \times 10^5$ |
| Use Concentration-1.0% | $<0.7 \times 10^4$ | $0.85 \times 10^4$ | $0.71 \times 10^5$ | $0.28 \times 10^5$ | $>1.9 \times 10^5$ | $>1.9 \times 10^5$ | $>1.9 \times 10^5$ |
| Use Concentration-2.0% | $>1.4 \times 10^5$ | $>1.1 \times 10^5$ | $>1.1 \times 10^5$ | $0.11 \times 10^5$ | $>1.9 \times 10^5$ | $>1.9 \times 10^5$ | $>1.9 \times 10^5$ |
| Foaming Assmnt.-Dairy Pipe Line | Acceptable | Acceptable | Acceptable | Acceptable | Acceptable | Acceptable | Acceptable |

TABLE 18

Detergent Cleaning Performance and Germicidal Data

| Ingredients | Formulation Sequence 202 | 203 | 204 | 205 | 206 | 207 |
|---|---|---|---|---|---|---|
| Deionized Water | 33.1 | 20.6 | 34.85 | 34.85 | 27.85 | 35.85 |
| Acetic Acid | 0.25 | 0.25 | 1 | 1 | 1 | 1 |
| Duomeen S/SV | — | — | 0.15 | 0.15 | 0.15 | 0.15 |
| Duomeen T | 0.15 | 0.15 | — | — | — | — |
| Plurafac LF-303 | 1 | 1 | 1.5 | 1.5 | 1.5 | 1.5 |
| Plurafac S305-LF | — | — | 1.5 | 1.5 | 1.5 | 1.5 |
| Plurafac SLF-18B | 1 | 1 | — | — | — | — |

TABLE 18-continued

| Detergent Cleaning Performance and Germicidal Data | | | | | | |
|---|---|---|---|---|---|---|
| | Formulation Sequence | | | | | |
| Ingredients | 202 | 203 | 204 | 205 | 206 | 207 |
| Anhydrous Citric Acid | 0 | 3 | 3 | 3 | 3 | 3 |
| Phosphoric Acid (75%) Food Grade | 16 | 20 | 55 | 55 | 55 | 55 |
| Nitric Acid (70%) | — | — | | — | — | 2 |
| Ventocil P (20%) | — | — | — | — | 10 | — |
| Glycolic Acid | — | — | 3 | — | — | — |
| Polyaspartic Acid Sodium Salt(40%) | — | — | — | 3 | — | — |
| Sodium Xylene Sulfonate (40%) | 35.5 | 36 | — | — | — | — |
| Methane Sulfonic Acid (70%) | 10 | 15 | — | — | — | — |
| Emery Fatty Acid 658 | 3 | 3 | — | — | — | — |
| Product Homogeneity | Clear | Clear | Clear Phase | Clear Phase | Clear Phase | Clear Phase |
| pH: Neat ('c)/Wash pH @ 400 ppm HW | 0.32 | 0.18 | 0.82(25.0)/1.94 | 0.95(25.6)/1.94 | 0.82(26.0)/1.96 | 0.78(24.7)/1.91 |
| Sp. Gravity (23.6° C.), g/mL | 1.182 | 1.238 | 1.321 | 1.318 | 1.315 | 1.318 |
| Cleaning Performance, 5 g/L Use Concentration | | | | | | |
| Wash Temperature, 60° C./8 Minutes | — | 97.85 | — | — | — | — |
| Wash Temperature, 40° C./8 Minutes | 71.3 | 79.11 | — | — | — | — |
| Usage Concentration, g/L | — | — | 5 g/L | 5 g/L | 5 g/L | 5 g/L |
| Wash Temperature, ° C. | — | — | 60 | 61 | 61 | 60 |
| Milk Soil Cleaning/400 ppm HW, % | — | — | 96 | 97 | 97 | 96 |
| Powder Chloroalkaline Detergent Control @ 2 g/L, % | — | — | 95 | 95 | 95 | 95 |
| Bacterial Activity-EN 1040 Report | | | | | | |
| *Pseudomonas Aeruginosa* | Reduction | Reduction | Reduction | Reduction | Reduction | Reduction |
| Use Concentration-0.5% | $>1.3 \times 10^5$ | $>1.3 \times 10^5$ | $>1.8 \times 10^5$ | $>1.3 \times 10^5$ | $>1.3 \times 10^5$ | $>1.8 \times 10^5$ |
| Use Concentration-1.0% | $>1.3 \times 10^5$ | $>1.3 \times 10^5$ | $>1.8 \times 10^5$ | $>1.3 \times 10^5$ | $>1.3 \times 10^5$ | $>1.8 \times 10^5$ |
| Use Concentration-2.0% | $>1.3 \times 10^5$ | $>1.3 \times 10^5$ | $>1.8 \times 10^5$ | $>1.3 \times 10^5$ | $>1.3 \times 10^5$ | $>1.8 \times 10^5$ |
| *Staphylococcus Aureus* | Reduction | Reduction | Reduction | Reduction | Reduction | Reduction |
| Use Concentration-0.5% | $>1.9 \times 10^5$ | $>1.3 \times 10^5$ | $<0.7 \times 10^4$ | $<0.7 \times 10^4$ | $<0.7 \times 10^4$ | $<0.7 \times 10^4$ |
| Use Concentration-1.0% | $>1.9 \times 10^5$ | $>1.9 \times 10^5$ | $<0.7 \times 10^4$ | $<0.7 \times 10^4$ | $<0.7 \times 10^4$ | $<0.7 \times 10^4$ |
| Use Concentration-2.0% | $>1.9 \times 10^5$ | $>1.9 \times 10^5$ | $<0.7 \times 10^4$ | $<0.7 \times 10^4$ | $<0.7 \times 10^4$ | $<0.7 \times 10^4$ |
| Foaming Assmnt.-Dairy Pipe Line | Acceptable | Acceptable | Acceptable | Acceptable | Acceptable | Acceptable |

TABLE 19

| Detergent Cleaning Performance and Germicidal Data | | | | | |
|---|---|---|---|---|---|
| | Formulation Sequence | | | | |
| Ingredients | 208 | 209 | 210 | 211 | 212 |
| Deionized Water | 17.9985 | 18.8485 | 16.8485 | 36.85 | 26.85 |
| Acetic Acid | — | 1 | 1 | 1 | 1 |
| Duomeen S/SV | — | 0.15 | 0.15 | 0.15 | 0.15 |
| Plurafac LF-303 | — | 1.5 | — | 1 | 1.5 |
| Plurafac S305-LF | — | 1.5 | — | — | — |
| Plurafac SLF-18B | 3 | — | 3 | 2 | 1.5 |
| Anhydrous Citric Acid | 3 | 3 | 3 | — | — |
| Anhydrous Citric Acid | — | — | — | 3 | 3 |
| Phosphoric Acid (75%) Food Grade | 43 | 43 | 43 | 20 | 33 |
| Sodium Xylene Sulfonate (40%) | 28 | 26 | 28 | 26 | 0 |
| Sodium Bisulfate-Animal Feed Grade | 5 | 5 | 5 | 0 | — |
| Capric/Caprylic Acid (40/60) | — | — | — | 2 | 0 |
| Glycolic Acid | — | — | — | — | — |
| Sulfamic Acid | — | — | — | 5 | 0 |
| Propylene Glycol | — | — | — | 3 | 3 |
| FD&C Yellow #5 Color | 0.0015 | 0.0015 | 0.0015 | 0 | 0 |
| Product Homogeneity | Clear/Separated | Clear Phase | Clear/Separated | Clear | Clear |
| pH: Neat (° C.)/Wash pH @ 400 ppm HW | 0.82(25.6)/1.94 | 0.82(26.0)/1.96 | 0.78(24.7)/1.91 | — | — |
| Sp. Gravity (23.6° C.), g/mL | 1.3322 | 1.3479 | 1.3464 | — | — |
| Cleaning Performance, 5 gm/L Use Concentration | | | | | |
| Wash Temperature, 60° C./8 Minutes | 97(−3) | 96(−1) | 96(−2) | — | — |

TABLE 19-continued

| Detergent Cleaning Performance and Germicidal Data | | | | | |
|---|---|---|---|---|---|
| | Formulation Sequence | | | | |
| Ingredients | 208 | 209 | 210 | 211 | 212 |
| Wash Temperature, 60° C./4 Minutes | 90(−3) | 96(−2) | 94(−1) | — | — |
| Wash Temperature, 40° C./8 Minutes | 66(−4) | 74(−2) | 80(−1) | — | — |
| Wash Temperature, 40° C./4 Minutes | 61(−4) | 59(−3) | 70(−2) | — | — |
| Bactericidal Activity-EN 1040 Report | | | | | |
| *Pseudomonas Aeruginosa* | Reduction | Reduction | Reduction | Reduction | Reduction |
| Use Concentration-0.5% | $>1.3 \times 10^5$ | $>1.3 \times 10^5$ | $>1.8 \times 10^5$ | $>1.3 \times 10^5$ | $>1.3 \times 10^5$ |
| Use Concentration-1.0% | $>1.3 \times 10^5$ | $>1.3 \times 10^5$ | $>1.8 \times 10^5$ | $>1.3 \times 10^5$ | $>1.3 \times 10^5$ |
| Use Concentration-2.0% | $>1.3 \times 10^5$ | $>1.3 \times 10^5$ | $>1.8 \times 10^5$ | $>1.3 \times 10^5$ | $>1.3 \times 10^5$ |
| *Staphylococcus Aureus* | Reduction | Reduction | Reduction | Reduction | Reduction |
| Use Concentration-0.5% | $0.11 \times 10^5$ | $<0.06 \times 10^5$ | $<0.06 \times 10^5$ | $0.94 \times 10^4$ | $0.94 \times 10^4$ |
| Use Concentration-1.0% | $>1.2 \times 10^5$ | $>1.2(1.0) \times 10^5$ | $>1.2 \times 10^5$ | $>1.9 \times 10^5$ | $>1.9 \times 10^5$ |
| Use Concentration-2.0% | $>1.2 \times 10^5$ | $>1.2(1.0) \times 10^5$ | $>1.2 \times 10^5$ | $>1.9 \times 10^5$ | $>1.9 \times 10^5$ |
| Foaming Assmnt.-Dairy Pipe Line | Acceptable | Acceptable | Acceptable? | Acceptable | Acceptable |

TABLE 20

| Detergent Cleaning Performance and Germicidal Data | | | | |
|---|---|---|---|---|
| | Formulation Sequence | | | |
| Ingredients | 213 | 214 | 215 | 216 |
| Deionized Water | 66.6 | 68.6 | 60.85 | 60 |
| Acetic Acid | 0.25 | 0.25 | 1 | 0 |
| Duomeen S/SV | — | — | 0.15 | 0 |
| Duomeen T | 0.15 | 0.15 | — | — |
| Plurafac LF-303 | 1 | 1 | 1.5 | 1.5 |
| Plurafac SLF-18B | 2 | 1 | 1.5 | 1.5 |
| Phosphoric Acid (75%) Food Grade | 15 | 11 | 20 | 20 |
| Methane Sulfonic Acid | 15 | 18 | 15 | 15 |
| Capric/Caprylic Acid (40/60) | 0 | 0 | 0 | 2 |
| Product Homogeneity | Clear | Clear | Clear | Clear |
| pH: Neat (° C.)/Wash pH @ 400 ppm HW | 0.28 | 0.24 | — | — |
| Sp. Gravity (23.6° C.), g/mL | 1.129 | 1.121 | — | — |
| Cleaning Performance, 5 gm/L Use Concentration | | | | |
| Wash Temperature, 40° C./8 Minutes | 90.89 | 88.62 | — | — |
| *Pseudomonas Aeruginosa* | Reduction | Reduction | Reduction | Reduction |
| Use Concentration-0.5% | $>1.3 \times 10^5$ | $>1.3 \times 10^5$ | $>1.3 \times 10^5$ | $>1.3 \times 10^5$ |
| Use Concentration-1.0% | $>1.3 \times 10^5$ | $>1.3 \times 10^5$ | $>1.3 \times 10^5$ | $>1.3 \times 10^5$ |
| Use Concentration-2.0% | $>1.3 \times 10^5$ | $>1.3 \times 10^5$ | $>1.3 \times 10^5$ | $>1.3 \times 10^5$ |
| *Staphylococcus Aureus* | Reduction | Reduction | Reduction | Reduction |
| Use Concentration-0.5% | $>1.9 \times 10^5$ | $>1.9 \times 10^5$ | $>1.9 \times 10^5$ | $<0.94 \times 10^4$ |
| Use Concentration-1.0% | $>1.9 \times 10^5$ | $>1.9 \times 10^5$ | $>1.9 \times 10^5$ | $>1.9 \times 10^5$ |
| Use Concentration-2.0% | $>1.9 \times 10^5$ | $>1.9 \times 10^5$ | $>1.9 \times 10^5$ | $>1.9 \times 10^5$ |
| Foaming Assmnt.-Dairy Pipe Line | Acceptable | Acceptable | Acceptable | Acceptable |

TABLE 21

| Detergent Cleaning Performance and Germicidal Data | | | |
|---|---|---|---|
| Ingredients | 217 | 218 | 219 |
| Deionized Water | 21.85 | 25.85 | 26.35 |
| Acetic Acid | 1.00 | 1.00 | 1.00 |
| Duomeen SV | 0.15 | — | — |
| Genamin OLP 100 | — | 0.15 | 0.15 |
| Propyleneglycol | 3.00 | 3.00 | 3.00 |
| Plurafac LF 303 | 1.50 | 1.50 | 1.50 |
| Citric Acid Anhydrous | 3.00 | 3.00 | 3.00 |
| Phosphoric Acid 75% | 35.00 | 35.00 | 35.00 |
| Sodium Xylenesulfonate 40% | 30.00 | 25.00 | 25.00 |
| Emery 658 | 3.00 | 1.00 | 1.00 |
| Plurafac 18B-45 | 1.50 | 1.50 | 1.50 |
| Glycolic Acid | — | 3.00 | 2.50 |
| pH: Neat (22.2° C.) | 0.74 | 0.74 | 0.74 |
| Sp. Gravity (21.2° C.), g/mL | 1.257 | 1.257 | 1.257 |
| Cleaning Performance | | | |
| Wash Temperature, 60° C./8 Minutes | 97 | 97 | 94 |
| Germicidal Kill Data (AOAC Test #960.09) | | | |
| *Escherichia Coli* | Reduction | Reduction | Reduction |
| Use Concentration-0.5% | >7 log | >7 log | >7 log |
| *Staphylococcus Aureus* | Reduction | Reduction | Reduction |
| Use Concentration-0.5% | >7 log | >7 log | >7 log |
| Foam Volume, mL | | | |
| DNMC-Deionized Water | | | |
| 0.00 min | 290 | 455 | 415 |
| 0.25 min | 70 | 260 | 150 |
| 0.50 min | 30 | 55 | 40 |
| 1.00 min | 20 | 35 | 10 |
| 5.00 min | 0 | 0 | 0 |
| DNMC-HD Water | | | |
| 0.00 min | 200 | 375 | 300 |
| 0.25 min | 20 | 70 | 65 |
| 0.50 min | 10 | 25 | 15 |
| 1.00 min | 0 | 15 | 10 |
| 5.00 min | 0 | 0 | 0 |

Another, more stringent standard for assessing die bactericidal activity of chemical disinfectants and antiseptics is European Standard EN 1276. This standard is generally applicable for the following areas: (a) processing, distribution, and retailing of food of animal origin (milk and milk products, meat and meat products, fish, seafood, and related products, eggs and egg products, animal feeds); (b) food of vegetable origin (beverages, fruits, vegetables and derivatives, flour, milling and baking, animal feeds); (c) institutional and domestic areas (catering establishments, public areas, schools, nurseries, shops, sports rooms, waste containers, hotels, dwellings, clinically non sensitive areas of hospitals, offices); and (d) other industrial applications (packaging material, biotechnology-yeast, proteins, enzymes, pharmaceutical, cosmetics and toiletries, textiles, space industry, computer industry).

For a product to be certified under this test procedure, the product must meet the following minimum criteria. When diluted in hard water at 20° C. and upon a 5 minute exposure time, under clean conditions (0.3 g/L bovine albumin), or dirty conditions (3 g/L bovine albumin), the product must demonstrate a $10^5$ reduction (5 log reduction i.e., 99.999% reduction) in vial counts for four selected reference strains: *Pseudomonas aeruginosa* (ATCC 15442), *Staphylococcus aureus* (ATCC 6538), *Escherichia coli* (ATCC 10536), and *Enterococcus hirae* (ATCC 10541).

In performing this test, a suspension of bacteria was added to a prepared sample of the detergent formulation being tested. The mixture was maintained at 20° C. After a specified contact time (5 minutes), an aliquot was taken and the bactericidal action in this portion was immediately neutralized or suppressed by a validation method, (i.e., by a dilution-neutralization method). The neutralizing composition used comprised: 3 g lecithin, 30 g polysorbate 80, 5 g sodium thiosulphate, 1 g L-histidine chlorhydrate, 30 g saponine, QS of distilled water to 500 mL, 10 mL of 0.25 M phosphate buffer, and QS of distilled water to 1000 mL.

Two different detergent formulations (formulas 136 and 139 from Table 10) were tested under a variety of test conditions. The results are shown in Table 22.

TABLE 22

| Reduction in Microbes for Testing Under European Standard EN 1276 | | | | | |
|---|---|---|---|---|---|
| | Concentration (v/v) | | | | |
| | 0.3% | 0.4% | 0.5% | 1.0% | 2.0% |
| Formula 139 @ 40° C.-Clean Conditions (0.3 g/L Bovine Albumin), Reduction of Bacteria | | | | | |
| *Pseudomonas aeruginosa* | $>1.7 \times 10^5$ | $>1.7 \times 10^5$ | $>1.7 \times 10^5$ | $>1.7 \times 10^5$ | $>1.7 \times 10^5$ |
| *Staphylococcus aureus* | $>1.2 \times 10^5$ | $>1.2 \times 10^5$ | $>1.2 \times 10^5$ | $>1.2 \times 10^5$ | $>1.2 \times 10^5$ |
| *Escherichia coli* | $>1.0 \times 10^5$ | $>1.0 \times 10^5$ | $>1.0 \times 10^5$ | $>1.0 \times 10^5$ | $>1.0 \times 10^5$ |
| *Enterococcus hirae* | $6.6 \times 10^3$ | $2.6 \times 10^4$ | $>1.4 \times 10^5$ | $>1.4 \times 10^5$ | $>1.4 \times 10^5$ |
| Formula 139 @ 40° C.-Dirty Conditions (3.0 g/L Bovine Albumin), Reduction of Bacteria | | | | | |
| *Pseudomonas aeruginosa* | $>1.3 \times 10^5$ | $>1.3 \times 10^5$ | $>1.3 \times 10^5$ | $>1.3 \times 10^5$ | $>1.3 \times 10^5$ |
| *Staphylococcus aureus* | $<7.0 \times 10^3$ | $4.4 \times 10^4$ | $>1.4 \times 10^5$ | $>1.4 \times 10^5$ | $>1.4 \times 10^5$ |
| *Escherichia coli* | $>1.1 \times 10^5$ | $>1.1 \times 10^5$ | $>1.1 \times 10^5$ | $>1.1 \times 10^5$ | $>1.1 \times 10^5$ |
| *Enterococcus hirae* | $<6.6 \times 10^3$ | $1.1 \times 10^4$ | $>1.3 \times 10^5$ | $>1.3 \times 10^5$ | $>1.3 \times 10^5$ |
| Formula 139 @ 40° C.-Dirty Conditions (10 g/L Reconstituted Milk), Reduction of Bacteria | | | | | |
| *Pseudomonas aeruginosa* | $>1.4 \times 10^5$ | $>1.4 \times 10^5$ | $>1.4 \times 10^5$ | $>1.4 \times 10^5$ | $>1.4 \times 10^5$ |
| *Staphylococcus aureus* | $<5.0 \times 10^3$ | $3.3 \times 10^4$ | $>1.0 \times 10^5$ | $>1.0 \times 10^5$ | $>1.0 \times 10^5$ |

TABLE 22-continued

| Reduction in Microbes for Testing Under European Standard EN 1276 | | | | | |
|---|---|---|---|---|---|
| | Concentration (v/v) | | | | |
| | 0.3% | 0.4% | 0.5% | 1.0% | 2.0% |
| *Escherichia coli* | $>1.7 \times 10^5$ | $>1.7 \times 10^5$ | $>1.7 \times 10^5$ | $>1.7 \times 10^5$ | $>1.7 \times 10^5$ |
| *Enterococcus hirae* | $<9.0 \times 10^3$ | $5.3 \times 10^4$ | $>1.8 \times 10^5$ | $>1.8 \times 10^5$ | $>1.8 \times 10^5$ |
| Formula 139 @ 20° C.-Dirty Conditions (3.0 g/L Bovine Albumin), Reduction of Bacteria | | | | | |
| *Pseudomonas aeruginosa* | $>1.6 \times 10^5$ | $>2.0 \times 10^5$ | $>2.0 \times 10^5$ | $>2.0 \times 10^5$ | $>2.0 \times 10^5$ |
| *Staphylococcus aureus* | $<1.6 \times 10^3$ | $2.6 \times 10^4$ | $>1.2 \times 10^5$ | $>1.2 \times 10^5$ | $>1.2 \times 10^5$ |
| *Escherichia coli* | $<8.0 \times 10^3$ | $>1.6 \times 10^5$ | $>1.6 \times 10^5$ | $>1.6 \times 10^5$ | $>1.6 \times 10^5$ |
| *Enterococcus hirae* | $<5.6 \times 10^3$ | $<5.6 \times 10^3$ | $<5.6 \times 10^3$ | $>1.1 \times 10^5$ | $>1.1 \times 10^5$ |
| Formula 139 @ 20° C.-Clean Conditions (0.3 g/L Bovine Albumin), Reduction of Bacteria | | | | | |
| *Pseudomonas aeruginosa* | $>1.1 \times 10^5$ | $>1.1 \times 10^5$ | $>1.1 \times 10^5$ | $>1.1 \times 10^5$ | $>1.1 \times 10^5$ |
| *Staphylococcus aureus* | $>1.5 \times 10^5$ | $>1.5 \times 10^5$ | $>1.5 \times 10^5$ | $>1.5 \times 10^5$ | $>1.5 \times 10^5$ |
| *Escherichia coli* | $>1.7 \times 10^5$ | $>1.7 \times 10^5$ | $>1.7 \times 10^5$ | $>1.7 \times 10^5$ | $>1.7 \times 10^5$ |
| *Enterococcus hirae* | $<6.6 \times 10^3$ | $<6.6 \times 10^3$ | $7.7 \times 10^4$ | $1.3 \times 10^5$ | $1.3 \times 10^5$ |
| Formula 136 @ 20° C.-Dirty Conditions (3.0 g/L Bovine Albumin), Reduction of Bacteria | | | | | |
| *Pseudomonas aeruginosa* | $3.7 \times 10^4$ | $>1.6 \times 10^5$ | $>1.6 \times 10^5$ | $>1.6 \times 10^5$ | $>1.6 \times 10^5$ |
| *Staphylococcus aureus* | $<5.6 \times 10^3$ | $<5.6 \times 10^3$ | $>1.1 \times 10^5$ | $>1.1 \times 10^5$ | $>1.1 \times 10^5$ |
| *Escherichia coli* | $<5.7 \times 10^3$ | $2.9 \times 10^4$ | $>1.1 \times 10^5$ | $>1.1 \times 10^5$ | $>1.1 \times 10^5$ |
| *Enterococcus hirae* | $<6.3 \times 10^3$ | $<6.3 \times 10^3$ | $<6.3 \times 10^3$ | $1.3 \times 10^5$ | $1.3 \times 10^5$ |

Sequestrants, Builders and Chelating Agents

Sequestrants, builders, and chelating agents are used in detergent compositions to soften or treat water and to prevent the formation of precipitates or other salts. Generally, sequestrants complex or coordinate the metal ions commonly found in the service water and thereby prevent the metal ions from interfering with the functioning of the detersive components within the composition.

Water soluble builders and sequestrants enhance the cleaning performance of detergents especially in hard water conditions. Preferred builders include alkali metal salts especially the alkali metal polyphosphates salts such as alkali metal pyrophosphates (e.g., tetrasodium or tetrapotassium pyrophosphates), alkali metal tripolyphosphates (e.g., sodium or potassium tripolyphosphate, either anhydrous or hydrated), alkali metal metaphosphates (e.g., sodium or potassium hexametaphoshates), and alkali metal orthophosphates (e.g., trisodium or tripotassium orthophosphate).

Inorganic and organic non-phosphate detergent builder salts can also be used in the present detergent compositions. Preferred inorganic non-phosphate builder salts are selected from the group consisting of alkali metal borates, carbonates and bicarbonates, and water insoluble aluminosilicates and zeolites, both crystalline and amorphous. Exemplary inorganic non-phosphate builder salts include sodium tetraborate, sodium carbonate, sodium bicarbonate, sodium sesquicarbonate, potassium carbonate, potassium bicarbonate, and sodium and potassium zeolites. Preferred organic non-phosphate builder and sequestrant salts include alkali metal salts of polycarboxylic acid and nitriloacetic acid. Exemplary inorganic non-phosphate builder salts include monosodium, disodium and trisodium citrate and tetrasodium ethylenediaminetetracetic acid (EDTA-$Na_4$). Mixtures of alkali polyphosphates and conventional organic and/or inorganic builder salts may also be employed.

It is preferable to supplement any polyphosphate builder salts with an auxiliary builder such as an alkali metal polycarboxylate salt (i.e., the alkali metal salts of citric acid and tartaric acid). The sodium salts of citric acid are preferred.

Optionally, low molecular weight non-cross-linked polyacrylates having a molecular weights of about 1,000-100,000, more preferably from about 2,000-80,000, and most preferably about 4500 are used along with the builder salts. Water soluble salts of acrylic acid and methacrylic acid homopolymers are particularly preferred. The water soluble salts may be an alkali metal salt such as potassium or sodium salt, an ammonium salt, or a substituted ammonium salt. The salt may be in partially or fully neutralized form. Exemplary low molecular weight non-cross-linked polyacrylates are available from Rohm and Hass under the name ACUSOL. Acusol® 445N, which has a molecular weight of about 4,500, is particularly preferred.

A mixture of an acrylic acid homopolymer and a maleic/olefin copolymer can also be used as the non-cross-linked polyacrylate. The copolymer can be derived from a substituted or unsubstituted maleic anhydride and a lower olefin in place of all or a portion of the cyclic anhydride. Preferably, the maleic anhydride monomer is of the general formula:

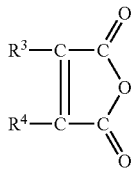

Where R3 and R4 are, independently selected from the group consisting of H, (C1-C4) alkyl, phenyl, (C1-C4) alkylphenyl, and phenyl (C1-C4) alkylene. The lower olefin component is preferably a (C1-C4) olefin, such as ethylene, propylene, isopropylene, butylene or isobutylene. These copolymers have molecular weights ranging from about 1000-100,000, and preferably from about 1000-15,000. Acusol® 460N, which has a molecular weight of about 15,000, is particularly preferred. Other exemplary copolymers include Sokalan® CP 45, from BASF, which is a partially neutralized copolymer of methacrylic acid and maleic anhydride sodium salt, and Sokalan® CP5, which is a fully neutralized salt. These water soluble non-cross-linked polyacrylate polymers, either alone or in combination preferably comprise from 0-10% by weight of the detergent composition.

The builder functionality can also be provided by a mixture of organic polycarboxylic acids such as citric acid, polyacrylic acid, polyacrylic/maleic acid, ethylenediaminetetraacetic acid (EDTA), polyaspartic acid, nitrilotriacetic acid NTA), and polyphosphonic acid.

The inventive compositions generally comprise from 0-30% by weight of a builder or sequestrant, more preferably about 1-25% by weight, and most preferably from about 2-15% by weight.

It is preferable to use a chelating agent or mixtures of agents in the detergent compositions to control hard water. Chelating agents can be present at a level from about 0-10% by weight, and preferably from about 0.01-5% by weight. Preferred chelating agents include phosphonate chelating agents such as alkali metal ethane 1-hydroxy diphosphonates (HEDP), poly alkylene phosphonate, and amino phosphonate compounds such as amino trimethylene phosphonic acid (ATMP), nitrilotrimethylene phosphonates (NTP), ethylenediaminetetramethylene phosphonates, and diethylene triamine pentamethylene phosphonates (DTPMP). The phosphonate compounds can be present either in acid form or as salts. Particularly preferred phosphonate chelating agents are diethylene triamine pentamethylene phosphonate (DTPMP) and ethane 1-hydroxy diphosphonate (HEDP) and are commercially available from Monsanto under the name DEQUEST. All exemplary biodegradable chelating agent for use in the inventive detergent compositions is ethylenediamine-N, N-disuccinic acid, or alkali and alkaline earth metal salts thereof.

Another type of preferred chelating agents for use herein include amino carboxylates such as ethylenediaminetetraacetic acid (EDTA), diethylenetriaminepentaacetic acid (DTPA), and propylenediaminetetraacetic acid (PDTA) either in acid form, or as the corresponding alkali and alkaline earth metal salts (i.e., EDTA-$Na_4$). Additional preferred carboxylate chelating agents include salicylic acid, aspartic acid, glutamic acid, glycine, malonic acid, polyaspartic acid citrates, acrylates, polyacrylates, or mixtures thereof.

Hydrotropes or Solubilizing/Coupling Agents

Hydrotrope or solubilizing agents can be used with the acid detergent compositions to solubilize any short chain fatty acids and other dispersible organic materials such as nonionic surfactants in solution over a range of temperatures. The hydrotrope or solubilizer component is preferably a nonionic or anionic material. Preferred anionic surfactants include the alkane sulfonates such as alkali metal alkane sulfonates and disulfonates, alkyl sulfates, linear alkyl benzene or naphthalene sulfonates, α-olefin sulfonates, secondary alkane sulfonates, alkyl ether sulfates or sulfonates, alkyl phosphates or phosphonates, dialkaylsulfosuccinates, dialkylsulfosuccinic esters, and sugar esters such as sorbitan esters and C8-C10 alkyl glucosides. Even high foaming hydrotropes such as C8, C10, C12 alkyl sulfonate derivatives can be employed in applications where some foam is permissible.

Additional preferred hydrotrope agents include aryl sulfonates such as alkali metal aryl sulfonates and disulfonates, sodium xylene sulfonate, sodium cumene sulfonate, sodium naphthalene sulfonate, sodium toluene sulfonate, and sodium benzene sulfonate. A mixture of sodium 1-octane sulfonate and sodium 1,2-octane disulfonate is particularly preferred.

As an added benefit, some of the above hydrotropes or couplers independently exhibit antibacterial activity at low pH. This, of course, adds to the efficacy of the present invention, but is not the primary criterion used in selecting an appropriate coupler. Since it is the presence of fatty acids and α-hydroxy acids in the protonated neutral state that provides the primary biocidal activity, the coupler should be selected not for its independent antimicrobial activity but for its ability to provide effective interaction between the substantially insoluble fatty acids and the microorganisms which the present compositions control. Phosphoric acid also has been found to solubilize dispersible organic materials such as nonionic surfactants.

In the concentrated detergent formulations, the hydrotropes are preferably present at a level of from about 0-50% by weight, more preferably from about 5-45% by weight, and most preferably from about 8-40% by weight.

Defoaming and Anti-Foaming Agent

In those applications in which excessive foaming is to be avoided (i.e., CIP systems) an anti-foaming agent or defoamer can be used to assist the primary surfactant with reducing the formation of foam or breaking down the produced foam quickly. Preferred defoaming agents includes compounds produced by the condensation of a hydrophilic alkylene oxide group with an aliphatic or alkyl aromatic hydrophobic compound. Exemplary defoaming agents include polyethylene oxide condensates of alcohols or alkyl phenols (e.g., the condensation products of alcohol or alkyl phenols having an alkyl group containing from about 5 to about 15 carbon atoms in a straight chain or branch chain configuration) with ethylene oxide. The ethylene oxide is preferably present in amounts from about 10-60 moles of ethylene oxide per mole of alcohol or alkyl phenol. The alkyl substituents in such compounds may be derived from polymerized propylene, butylenes, isobutylene, and diisobutylene.

Additional preferred anti-foaming agents include the alkyl phosphate esters such as mono, di and trialkyl phosphate esters. Such phosphate esters are generally produced from C8-C12 aliphatic linear alcohols. Yet another type of preferred foam depressants are alkyl phosphoric acid esters having the general formula

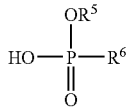

in which R5 and R6 are independently a C12-C20 alkyl or ethoxylated alkyl moiety. The alkyl phosphoric acid esters are generally present in the detergent compositions at a level of about 0-1.3% by weight, and more preferably from about 0.20-1.0% by weight. Even additional preferred defoaming agents include alcohol alkoxylates sold under name DEHYPON, SYNPERONIC, and DOWFAX. Silicone antifoaming agents including alkylated polysiloxanes such as polydimethylsiloxanes, polydiethylsiloxanes, polydibutylsiloxanes, phenylmethylsiloxanes, dimethylsilanated silica, trimethylsilanated silica and triethylsilanated silica can also be used in the detersive compositions. These silicone agents are preferably present at a level of about 0-2% by weight, and more preferably from about 0.20-1.5% by weight.

Generally, compositions according to the invention comprise from about 0.0-20% by weight of a defoaming agent, more preferably from about 0.2-15% by weight, and most preferably from about 1-10% by weight.

Other Ingredients

The balance of the inventive detergent (i.e., to give 100% by weight) is water, preferably deionized water. Organic solvents such as alcohols, glycols, polyethylene glycols, polypropylene glycols can be used for a non-aqueous system or in combination with water for an aqueous system. However, other ingredients such as perfume/fragrance, preservatives, colorants, solvents, buffers, stabilizers, radical scavengers, soil suspenders, crystals growth inhibiting agents, soil release agents, dispersants, dyestuffs, and pigments can be included provided they are stable in a highly acidic environment.

We claim:

1. A method of cleaning a clean-in-place (CIP) system comprising contacting the surfaces of said CIP system with a liquid detergent comprising an acid selected from the group consisting of inorganic acids, organic acids, and mixtures thereof, and a fatty alkyl-1,3-diaminopropane or salt thereof having the general formula R—NH—$CH_2CH_2CH_2NH_2$, where R is a C4-C22 alkyl group, said liquid detergent having a pH from 0.1 to 5.0.

2. The method of claim 1, further comprising the step of diluting said composition to form a use solution prior to said contacting step.

3. The method of claim 2, said use solution comprising from about 0.00003-0.0075% by weight of said fatty alkyl-1,3-diaminopropane or salt thereof.

4. The method of claim 1, said CIP system being a milk-handling system, a food processing plant, or food or beverage processing equipment.

5. The method of claim 1, said CIP system surfaces being contaminated with food, milk, or beverage soils prior to said application step.

6. The method of claim 1, said method resulting in the cleaning, sanitizing, and descaling of said CIP surfaces in a single step washing cycle.

7. The method of claim 1, said fatty alkyl- 1,3-diaminopropane being derived from coconut, soy, tallow, or oleo sources.

8. The method of claim 1, said organic acid having the general formula R'—$SO_3H$, wherein R' is a C1-C16 alkyl group.

9. The method of claim 1, said organic acid selected from a group consisting of citric acid, methane sulfonic acid, ethane sulfonic acid, propane sulfonic acid, butane sulfonic acid, acetic acid, hydroxy acetic acid, propionic acid, hydroxy propionic acid, a-ketopropionic acid, butyric acid, mandelic acid, valeric acid, succinic acid, tartaric acid, malic acid, oxalic acid, fumaric acid, adipic acid, maleic acid, sorbic acid, benzoic acid, succinic acid, glutaric acid, adipic acid, α-hydroxy acids, ethylenediaminetetraacctic acid (EDTA), phosphonic acid, octyl phosphoric acid, acrylic acid, polyacrylic acid, aspartic acid, polyaspartic acid, p-hydroxybenzoic acids, iminoacetic acids, and mixtures thereof.

10. The method of claim 1, said detergent further comprising a surfactant system comprising at least two different surfactants.

11. The method of claim 10, said two different surfactants being selected from the group consisting of anionic, nonionic, cationic, amphoteric, and zwitterionic surfactants and mixtures thereof.

12. The method of claim 1, said detergent further comprising up to about 20% by weight of an acid active or acid resistant enzyme or mixture of enzymes.

13. The method of claim 12, said enzyme being selected from the group consisting of acid active or acid resistant protease enzymes, acid lipolase enzymes, lipase enzymes, acid resistant amylase enzymes, cellulase enzymes, acid peroxidase, and combinations thereof.

14. The method of claim 1, said detergent further comprising from about 0-50% by weight of a hydrotropic agent.

15. The method of claim 1, said detergent further comprising one or more ingredients selected from the group consisting of sequesterants, builders, and chelating agents.

16. A method of reducing the foaming of an acidic detergent during cleaning of a CIP system comprising contacting the surfaces of a CIP system with a detergent comprising a fatty alkyl-1,3-diaminopropane or salt thereof having the general formula R—NH—$CH_2CH_2CH_2NH_2$, wherein R is a C4-C2 alkyl group, said detergent including a surfactant system comprising at least two different surfactants, said acidic detergent having a pH from 0.1 to 5.0.

17. The method of claim 16, said surfactants being individually selected from the group consisting of anionic, nonionic, cationic, anphoteric, and zwitterionic surfactants and mixtures thereof.

18. The method of claim 17, said surfactants being individually selected from the group consisting of amine oxides, phosphine oxides, sulphoxides, sulfonates, sulfates, betaines, primary alkyl sulfates, alkyl sulfonates, arylalkylsulfonates, secondary alkylsulfonates, poly-lower alkoxylated higher alcohols and ethers, alkoxylated linear fatty alcohols, alkylpolysaccharides, quaternary ammonium compounds, salts of primary, secondary, and tertiary fatty amines, and combinations thereof.

19. The method of claim 1, said liquid detergent having a pH from 0.1 to 4.0.

20. The method of claim 16, said acidic detergent having a pH from 0.1 to 4.0.

* * * * *